US008289673B2

(12) United States Patent
Gorczyca et al.

(10) Patent No.: US 8,289,673 B2
(45) Date of Patent: Oct. 16, 2012

(54) MULTIPLE-AXIS CONTROL APPARATUS FOR IONIZATION SYSTEMS

(75) Inventors: John A. Gorczyca, Lansdale, PA (US); Manuel C. Blanco, Hillsborough, NJ (US); Steven J. Mandrachia, Eagleville, PA (US)

(73) Assignee: Illinois Tool Works Inc., Glenview, IL (US)

( * ) Notice: Subject to any disclaimer, the term of this patent is extended or adjusted under 35 U.S.C. 154(b) by 236 days.

(21) Appl. No.: 12/265,754

(22) Filed: Nov. 6, 2008

(65) Prior Publication Data

US 2009/0128981 A1 May 21, 2009

Related U.S. Application Data

(60) Provisional application No. 61/003,733, filed on Nov. 19, 2007.

(51) Int. Cl.
*H01T 23/00* (2006.01)

(52) U.S. Cl. ..... 361/230

(58) Field of Classification Search ..... 361/230
See application file for complete search history.

(56) References Cited

U.S. PATENT DOCUMENTS

| | | | | |
|---|---|---|---|---|
| 3,977,848 | A * | 8/1976 | Oliphant | 96/19 |
| 4,757,421 | A * | 7/1988 | Mykkanen | 361/231 |
| 4,809,127 | A | 2/1989 | Steinman et al. | |
| 4,924,170 | A * | 5/1990 | Henze | 323/272 |
| 4,951,172 | A | 8/1990 | Steinman et al. | |
| 2006/0203416 | A1 * | 9/2006 | Taylor et al. | 361/230 |

FOREIGN PATENT DOCUMENTS

| | | | |
|---|---|---|---|
| EP | 1401247 | A2 | 3/2004 |
| WO | 2007118182 | A2 | 10/2007 |

OTHER PUBLICATIONS

Search Report issued Apr. 25, 2012 in EP Application No. 08168821.0.

* cited by examiner

*Primary Examiner* — Rexford Barnie
*Assistant Examiner* — Ann Hoang
(74) *Attorney, Agent, or Firm* — Panitch Schwarze Belisario & Nadel LLP

(57) ABSTRACT

A bipolar ionization apparatus includes a positive high voltage power supply having an output with at least one positive ion emitting electrode connected thereto and configured to generate positive ions. A negative high voltage power supply has an output with at least one negative ion emitting electrode connected thereto and is configured to generate negative ions. A controller for an ionizer outputs a positive high voltage ionization waveform and a negative high voltage ionization waveform. The controller simultaneously adjusts an amplitude and a duty cycle of each of the waveforms.

12 Claims, 28 Drawing Sheets

| | pos in | neg in | AMPLITUDE CONTROL | | | | | | | | |
|---|---|---|---|---|---|---|---|---|---|---|---|
| "Time" | | | EQUAL | | SHIFTED POS | | SHIFTED NEG | | EQ | POS | NEG |
| | | | POS | NEG | POS | NEG | POS | NEG | SUM | SUM | SUM |
| 1 | 1 | 0 | 1 | 0 | 1.2 | 0 | 0.8 | 0 | 1 | 1.2 | 0.8 |
| 2 | 1 | 0 | 1 | 0 | 1.2 | 0 | 0.8 | 0 | 1 | 1.2 | 0.8 |
| 3 | 1 | 0 | 1 | 0 | 1.2 | 0 | 0.8 | 0 | 1 | 1.2 | 0.8 |
| 4 | 1 | 0 | 1 | 0 | 1.2 | 0 | 0.8 | 0 | 1 | 1.2 | 0.8 |
| 5 | 1 | 0 | 1 | 0 | 1.2 | 0 | 0.8 | 0 | 1 | 1.2 | 0.8 |
| 6 | 1 | 0 | 1 | 0 | 1.2 | 0 | 0.8 | 0 | 1 | 1.2 | 0.8 |
| 7 | 1 | 0 | 1 | 0 | 1.2 | 0 | 0.8 | 0 | 1 | 1.2 | 0.8 |
| 8 | 1 | 0 | 1 | 0 | 1.2 | 0 | 0.8 | 0 | 1 | 1.2 | 0.8 |
| 9 | 1 | 0 | 1 | 0 | 1.2 | 0 | 0.8 | 0 | 1 | 1.2 | 0.8 |
| 10 | 1 | 0 | 1 | 0 | 1.2 | 0 | 0.8 | 0 | 1 | 1.2 | 0.8 |
| 11 | 1 | 0 | 1 | 0 | 1.2 | 0 | 0.8 | 0 | 1 | 1.2 | 0.8 |
| 12 | 1 | 0 | 1 | 0 | 1.2 | 0 | 0.8 | 0 | 1 | 1.2 | 0.8 |
| 13 | 1 | 0 | 1 | 0 | 1.2 | 0 | 0.8 | 0 | 1 | 1.2 | 0.8 |
| 14 | 1 | 0 | 1 | 0 | 1.2 | 0 | 0.8 | 0 | 1 | 1.2 | 0.8 |
| 15 | 1 | 0 | 1 | 0 | 1.2 | 0 | 0.8 | 0 | 1 | 1.2 | 0.8 |
| 16 | 1 | 0 | 1 | 0 | 1.2 | 0 | 0.8 | 0 | 1 | 1.2 | 0.8 |
| 17 | 1 | 0 | 1 | 0 | 1.2 | 0 | 0.8 | 0 | 1 | 1.2 | 0.8 |
| 18 | 1 | 0 | 1 | 0 | 1.2 | 0 | 0.8 | 0 | 1 | 1.2 | 0.8 |
| 19 | 1 | 0 | 1 | 0 | 1.2 | 0 | 0.8 | 0 | 1 | 1.2 | 0.8 |
| 20 | 1 | 0 | 1 | 0 | 1.2 | 0 | 0.8 | 0 | 1 | 1.2 | 0.8 |
| 21 | 1 | 0 | 1 | 0 | 1.2 | 0 | 0.8 | 0 | 1 | 1.2 | 0.8 |
| 22 | 1 | 0 | 1 | 0 | 1.2 | 0 | 0.8 | 0 | 1 | 1.2 | 0.8 |
| 23 | 1 | 0 | 1 | 0 | 1.2 | 0 | 0.8 | 0 | 1 | 1.2 | 0.8 |
| 24 | 1 | 0 | 1 | 0 | 1.2 | 0 | 0.8 | 0 | 1 | 1.2 | 0.8 |
| 25 | 1 | 0 | 1 | 0 | 1.2 | 0 | 0.8 | 0 | 1 | 1.2 | 0.8 |
| 26 | 1 | 0 | 1 | 0 | 1.2 | 0 | 0.8 | 0 | 1 | 1.2 | 0.8 |
| 27 | 1 | 0 | 1 | 0 | 1.2 | 0 | 0.8 | 0 | 1 | 1.2 | 0.8 |
| 28 | 1 | 0 | 1 | 0 | 1.2 | 0 | 0.8 | 0 | 1 | 1.2 | 0.8 |
| 29 | 1 | 0 | 1 | 0 | 1.2 | 0 | 0.8 | 0 | 1 | 1.2 | 0.8 |
| 30 | 1 | 0 | 1 | 0 | 1.2 | 0 | 0.8 | 0 | 1 | 1.2 | 0.8 |
| 31 | 1 | 0 | 1 | 0 | 1.2 | 0 | 0.8 | 0 | 1 | 1.2 | 0.8 |
| 32 | 1 | 0 | 1 | 0 | 1.2 | 0 | 0.8 | 0 | 1 | 1.2 | 0.8 |
| 33 | 1 | 0 | 1 | 0 | 1.2 | 0 | 0.8 | 0 | 1 | 1.2 | 0.8 |
| 34 | 1 | 0 | 1 | 0 | 1.2 | 0 | 0.8 | 0 | 1 | 1.2 | 0.8 |
| 35 | 1 | 0 | 1 | 0 | 1.2 | 0 | 0.8 | 0 | 1 | 1.2 | 0.8 |
| 36 | 1 | 0 | 1 | 0 | 1.2 | 0 | 0.8 | 0 | 1 | 1.2 | 0.8 |
| 37 | 1 | 0 | 1 | 0 | 1.2 | 0 | 0.8 | 0 | 1 | 1.2 | 0.8 |
| 38 | 1 | 0 | 1 | 0 | 1.2 | 0 | 0.8 | 0 | 1 | 1.2 | 0.8 |
| 39 | 1 | 0 | 1 | 0 | 1.2 | 0 | 0.8 | 0 | 1 | 1.2 | 0.8 |
| 40 | 1 | 0 | 1 | 0 | 1.2 | 0 | 0.8 | 0 | 1 | 1.2 | 0.8 |
| 41 | 1 | 0 | 1 | 0 | 1.2 | 0 | 0.8 | 0 | 1 | 1.2 | 0.8 |
| 42 | 1 | 0 | 1 | 0 | 1.2 | 0 | 0.8 | 0 | 1 | 1.2 | 0.8 |
| 43 | 1 | 0 | 1 | 0 | 1.2 | 0 | 0.8 | 0 | 1 | 1.2 | 0.8 |
| 44 | 1 | 0 | 1 | 0 | 1.2 | 0 | 0.8 | 0 | 1 | 1.2 | 0.8 |
| 45 | 1 | 0 | 1 | 0 | 1.2 | 0 | 0.8 | 0 | 1 | 1.2 | 0.8 |
| 46 | 1 | 0 | 1 | 0 | 1.2 | 0 | 0.8 | 0 | 1 | 1.2 | 0.8 |
| 47 | 1 | 0 | 1 | 0 | 1.2 | 0 | 0.8 | 0 | 1 | 1.2 | 0.8 |
| 48 | 1 | 0 | 1 | 0 | 1.2 | 0 | 0.8 | 0 | 1 | 1.2 | 0.8 |
| 49 | 1 | 0 | 1 | 0 | 1.2 | 0 | 0.8 | 0 | 1 | 1.2 | 0.8 |
| 50 | 1 | 0 | 1 | 0 | 1.2 | 0 | 0.8 | 0 | 1 | 1.2 | 0.8 |

FIG. 16A

| | pos in | neg in | AMPLITUDE CONTROL | | | | | | | | |
|---|---|---|---|---|---|---|---|---|---|---|---|
| "Time" | | | EQUAL | | SHIFTED POS | | SHIFTED NEG | | EQ | POS | NEG |
| | | | POS | NEG | POS | NEG | POS | NEG | SUM | SUM | SUM |
| 51 | 0 | -1 | 0 | -1 | 0 | -0.8 | 0 | -1.2 | -1 | -0.8 | -1.2 |
| 52 | 0 | -1 | 0 | -1 | 0 | -0.8 | 0 | -1.2 | -1 | -0.8 | -1.2 |
| 53 | 0 | -1 | 0 | -1 | 0 | -0.8 | 0 | -1.2 | -1 | -0.8 | -1.2 |
| 54 | 0 | -1 | 0 | -1 | 0 | -0.8 | 0 | -1.2 | -1 | -0.8 | -1.2 |
| 55 | 0 | -1 | 0 | -1 | 0 | -0.8 | 0 | -1.2 | -1 | -0.8 | -1.2 |
| 56 | 0 | -1 | 0 | -1 | 0 | -0.8 | 0 | -1.2 | -1 | -0.8 | -1.2 |
| 57 | 0 | -1 | 0 | -1 | 0 | -0.8 | 0 | -1.2 | -1 | -0.8 | -1.2 |
| 58 | 0 | -1 | 0 | -1 | 0 | -0.8 | 0 | -1.2 | -1 | -0.8 | -1.2 |
| 59 | 0 | -1 | 0 | -1 | 0 | -0.8 | 0 | -1.2 | -1 | -0.8 | -1.2 |
| 60 | 0 | -1 | 0 | -1 | 0 | -0.8 | 0 | -1.2 | -1 | -0.8 | -1.2 |
| 61 | 0 | -1 | 0 | -1 | 0 | -0.8 | 0 | -1.2 | -1 | -0.8 | -1.2 |
| 62 | 0 | -1 | 0 | -1 | 0 | -0.8 | 0 | -1.2 | -1 | -0.8 | -1.2 |
| 63 | 0 | -1 | 0 | -1 | 0 | -0.8 | 0 | -1.2 | -1 | -0.8 | -1.2 |
| 64 | 0 | -1 | 0 | -1 | 0 | -0.8 | 0 | -1.2 | -1 | -0.8 | -1.2 |
| 65 | 0 | -1 | 0 | -1 | 0 | -0.8 | 0 | -1.2 | -1 | -0.8 | -1.2 |
| 66 | 0 | -1 | 0 | -1 | 0 | -0.8 | 0 | -1.2 | -1 | -0.8 | -1.2 |
| 67 | 0 | -1 | 0 | -1 | 0 | -0.8 | 0 | -1.2 | -1 | -0.8 | -1.2 |
| 68 | 0 | -1 | 0 | -1 | 0 | -0.8 | 0 | -1.2 | -1 | -0.8 | -1.2 |
| 69 | 0 | -1 | 0 | -1 | 0 | -0.8 | 0 | -1.2 | -1 | -0.8 | -1.2 |
| 70 | 0 | -1 | 0 | -1 | 0 | -0.8 | 0 | -1.2 | -1 | -0.8 | -1.2 |
| 71 | 0 | -1 | 0 | -1 | 0 | -0.8 | 0 | -1.2 | -1 | -0.8 | -1.2 |
| 72 | 0 | -1 | 0 | -1 | 0 | -0.8 | 0 | -1.2 | -1 | -0.8 | -1.2 |
| 73 | 0 | -1 | 0 | -1 | 0 | -0.8 | 0 | -1.2 | -1 | -0.8 | -1.2 |
| 74 | 0 | -1 | 0 | -1 | 0 | -0.8 | 0 | -1.2 | -1 | -0.8 | -1.2 |
| 75 | 0 | -1 | 0 | -1 | 0 | -0.8 | 0 | -1.2 | -1 | -0.8 | -1.2 |
| 76 | 0 | -1 | 0 | -1 | 0 | -0.8 | 0 | -1.2 | -1 | -0.8 | -1.2 |
| 77 | 0 | -1 | 0 | -1 | 0 | -0.8 | 0 | -1.2 | -1 | -0.8 | -1.2 |
| 78 | 0 | -1 | 0 | -1 | 0 | -0.8 | 0 | -1.2 | -1 | -0.8 | -1.2 |
| 79 | 0 | -1 | 0 | -1 | 0 | -0.8 | 0 | -1.2 | -1 | -0.8 | -1.2 |
| 80 | 0 | -1 | 0 | -1 | 0 | -0.8 | 0 | -1.2 | -1 | -0.8 | -1.2 |
| 81 | 0 | -1 | 0 | -1 | 0 | -0.8 | 0 | -1.2 | -1 | -0.8 | -1.2 |
| 82 | 0 | -1 | 0 | -1 | 0 | -0.8 | 0 | -1.2 | -1 | -0.8 | -1.2 |
| 83 | 0 | -1 | 0 | -1 | 0 | -0.8 | 0 | -1.2 | -1 | -0.8 | -1.2 |
| 84 | 0 | -1 | 0 | -1 | 0 | -0.8 | 0 | -1.2 | -1 | -0.8 | -1.2 |
| 85 | 0 | -1 | 0 | -1 | 0 | -0.8 | 0 | -1.2 | -1 | -0.8 | -1.2 |
| 86 | 0 | -1 | 0 | -1 | 0 | -0.8 | 0 | -1.2 | -1 | -0.8 | -1.2 |
| 87 | 0 | -1 | 0 | -1 | 0 | -0.8 | 0 | -1.2 | -1 | -0.8 | -1.2 |
| 88 | 0 | -1 | 0 | -1 | 0 | -0.8 | 0 | -1.2 | -1 | -0.8 | -1.2 |
| 89 | 0 | -1 | 0 | -1 | 0 | -0.8 | 0 | -1.2 | -1 | -0.8 | -1.2 |
| 90 | 0 | -1 | 0 | -1 | 0 | -0.8 | 0 | -1.2 | -1 | -0.8 | -1.2 |
| 91 | 0 | -1 | 0 | -1 | 0 | -0.8 | 0 | -1.2 | -1 | -0.8 | -1.2 |
| 92 | 0 | -1 | 0 | -1 | 0 | -0.8 | 0 | -1.2 | -1 | -0.8 | -1.2 |
| 93 | 0 | -1 | 0 | -1 | 0 | -0.8 | 0 | -1.2 | -1 | -0.8 | -1.2 |
| 94 | 0 | -1 | 0 | -1 | 0 | -0.8 | 0 | -1.2 | -1 | -0.8 | -1.2 |
| 95 | 0 | -1 | 0 | -1 | 0 | -0.8 | 0 | -1.2 | -1 | -0.8 | -1.2 |
| 96 | 0 | -1 | 0 | -1 | 0 | -0.8 | 0 | -1.2 | -1 | -0.8 | -1.2 |
| 97 | 0 | -1 | 0 | -1 | 0 | -0.8 | 0 | -1.2 | -1 | -0.8 | -1.2 |
| 98 | 0 | -1 | 0 | -1 | 0 | -0.8 | 0 | -1.2 | -1 | -0.8 | -1.2 |
| 99 | 0 | -1 | 0 | -1 | 0 | -0.8 | 0 | -1.2 | -1 | -0.8 | -1.2 |
| 100 | 0 | -1 | 0 | -1 | 0 | -0.8 | 0 | -1.2 | -1 | -0.8 | -1.2 |

FIG. 16B

| | pos in | neg in | DUTY CYCLE CONTROL | | | | | | | | |
|---|---|---|---|---|---|---|---|---|---|---|---|
| "Time" | | | EQUAL | | SHIFTED POS | | SHIFTED NEG | | EQ | POS | NEG |
| | | | POS | NEG | POS | NEG | POS | NEG | SUM | SUM | SUM |
| 1 | 1 | 0 | 1 | 0 | 1 | 0 | 1 | 0 | 1 | 1 | 1 |
| 2 | 1 | 0 | 1 | 0 | 1 | 0 | 1 | 0 | 1 | 1 | 1 |
| 3 | 1 | 0 | 1 | 0 | 1 | 0 | 1 | 0 | 1 | 1 | 1 |
| 4 | 1 | 0 | 1 | 0 | 1 | 0 | 1 | 0 | 1 | 1 | 1 |
| 5 | 1 | 0 | 1 | 0 | 1 | 0 | 1 | 0 | 1 | 1 | 1 |
| 6 | 1 | 0 | 1 | 0 | 1 | 0 | 1 | 0 | 1 | 1 | 1 |
| 7 | 1 | 0 | 1 | 0 | 1 | 0 | 1 | 0 | 1 | 1 | 1 |
| 8 | 1 | 0 | 1 | 0 | 1 | 0 | 1 | 0 | 1 | 1 | 1 |
| 9 | 1 | 0 | 1 | 0 | 1 | 0 | 1 | 0 | 1 | 1 | 1 |
| 10 | 1 | 0 | 1 | 0 | 1 | 0 | 1 | 0 | 1 | 1 | 1 |
| 11 | 1 | 0 | 1 | 0 | 1 | 0 | 1 | 0 | 1 | 1 | 1 |
| 12 | 1 | 0 | 1 | 0 | 1 | 0 | 1 | 0 | 1 | 1 | 1 |
| 13 | 1 | 0 | 1 | 0 | 1 | 0 | 1 | 0 | 1 | 1 | 1 |
| 14 | 1 | 0 | 1 | 0 | 1 | 0 | 1 | 0 | 1 | 1 | 1 |
| 15 | 1 | 0 | 1 | 0 | 1 | 0 | 1 | 0 | 1 | 1 | 1 |
| 16 | 1 | 0 | 1 | 0 | 1 | 0 | 1 | 0 | 1 | 1 | 1 |
| 17 | 1 | 0 | 1 | 0 | 1 | 0 | 1 | 0 | 1 | 1 | 1 |
| 18 | 1 | 0 | 1 | 0 | 1 | 0 | 1 | 0 | 1 | 1 | 1 |
| 19 | 1 | 0 | 1 | 0 | 1 | 0 | 1 | 0 | 1 | 1 | 1 |
| 20 | 1 | 0 | 1 | 0 | 1 | 0 | 1 | 0 | 1 | 1 | 1 |
| 21 | 1 | 0 | 1 | 0 | 1 | 0 | 1 | 0 | 1 | 1 | 1 |
| 22 | 1 | 0 | 1 | 0 | 1 | 0 | 1 | 0 | 1 | 1 | 1 |
| 23 | 1 | 0 | 1 | 0 | 1 | 0 | 1 | 0 | 1 | 1 | 1 |
| 24 | 1 | 0 | 1 | 0 | 1 | 0 | 1 | 0 | 1 | 1 | 1 |
| 25 | 1 | 0 | 1 | 0 | 1 | 0 | 1 | 0 | 1 | 1 | 1 |
| 26 | 1 | 0 | 1 | 0 | 1 | 0 | 1 | 0 | 1 | 1 | 1 |
| 27 | 1 | 0 | 1 | 0 | 1 | 0 | 1 | 0 | 1 | 1 | 1 |
| 28 | 1 | 0 | 1 | 0 | 1 | 0 | 1 | 0 | 1 | 1 | 1 |
| 29 | 1 | 0 | 1 | 0 | 1 | 0 | 1 | 0 | 1 | 1 | 1 |
| 30 | 1 | 0 | 1 | 0 | 1 | 0 | 1 | 0 | 1 | 1 | 1 |
| 31 | 1 | 0 | 1 | 0 | 1 | 0 | 1 | 0 | 1 | 1 | 1 |
| 32 | 1 | 0 | 1 | 0 | 1 | 0 | 1 | 0 | 1 | 1 | 1 |
| 33 | 1 | 0 | 1 | 0 | 1 | 0 | 1 | 0 | 1 | 1 | 1 |
| 34 | 1 | 0 | 1 | 0 | 1 | 0 | 1 | 0 | 1 | 1 | 1 |
| 35 | 1 | 0 | 1 | 0 | 1 | 0 | 1 | 0 | 1 | 1 | 1 |
| 36 | 1 | 0 | 1 | 0 | 1 | 0 | 1 | 0 | 1 | 1 | 1 |
| 37 | 1 | 0 | 1 | 0 | 1 | 0 | 1 | 0 | 1 | 1 | 1 |
| 38 | 1 | 0 | 1 | 0 | 1 | 0 | 1 | 0 | 1 | 1 | 1 |
| 39 | 1 | 0 | 1 | 0 | 1 | 0 | 1 | 0 | 1 | 1 | 1 |
| 40 | 1 | 0 | 1 | 0 | 1 | 0 | 0 | -1 | 1 | 1 | -1 |
| 41 | 1 | 0 | 1 | 0 | 1 | 0 | 0 | -1 | 1 | 1 | -1 |
| 42 | 1 | 0 | 1 | 0 | 1 | 0 | 0 | -1 | 1 | 1 | -1 |
| 43 | 1 | 0 | 1 | 0 | 1 | 0 | 0 | -1 | 1 | 1 | -1 |
| 44 | 1 | 0 | 1 | 0 | 1 | 0 | 0 | -1 | 1 | 1 | -1 |
| 45 | 1 | 0 | 1 | 0 | 1 | 0 | 0 | -1 | 1 | 1 | -1 |
| 46 | 1 | 0 | 1 | 0 | 1 | 0 | 0 | -1 | 1 | 1 | -1 |
| 47 | 1 | 0 | 1 | 0 | 1 | 0 | 0 | -1 | 1 | 1 | -1 |
| 48 | 1 | 0 | 1 | 0 | 1 | 0 | 0 | -1 | 1 | 1 | -1 |
| 49 | 1 | 0 | 1 | 0 | 1 | 0 | 0 | -1 | 1 | 1 | -1 |
| 50 | 1 | 0 | 1 | 0 | 1 | 0 | 0 | -1 | 1 | 1 | -1 |

FIG. 17A

| | pos in | neg in | DUTY CYCLE CONTROL | | | | | | | | |
|---|---|---|---|---|---|---|---|---|---|---|---|
| "Time" | | | EQUAL | | SHIFTED POS | | SHIFTED NEG | | EQ | POS | NEG |
| | | | POS | NEG | POS | NEG | POS | NEG | SUM | SUM | SUM |
| 51 | 0 | -1 | 0 | -1 | 1 | 0 | 0 | -1 | -1 | 1 | -1 |
| 52 | 0 | -1 | 0 | -1 | 1 | 0 | 0 | -1 | -1 | 1 | -1 |
| 53 | 0 | -1 | 0 | -1 | 1 | 0 | 0 | -1 | -1 | 1 | -1 |
| 54 | 0 | -1 | 0 | -1 | 1 | 0 | 0 | -1 | -1 | 1 | -1 |
| 55 | 0 | -1 | 0 | -1 | 1 | 0 | 0 | -1 | -1 | 1 | -1 |
| 56 | 0 | -1 | 0 | -1 | 1 | 0 | 0 | -1 | -1 | 1 | -1 |
| 57 | 0 | -1 | 0 | -1 | 1 | 0 | 0 | -1 | -1 | 1 | -1 |
| 58 | 0 | -1 | 0 | -1 | 1 | 0 | 0 | -1 | -1 | 1 | -1 |
| 59 | 0 | -1 | 0 | -1 | 1 | 0 | 0 | -1 | -1 | 1 | -1 |
| 60 | 0 | -1 | 0 | -1 | 1 | 0 | 0 | -1 | -1 | 1 | -1 |
| 61 | 0 | -1 | 0 | -1 | 0 | -1 | 0 | -1 | -1 | -1 | -1 |
| 62 | 0 | -1 | 0 | -1 | 0 | -1 | 0 | -1 | -1 | -1 | -1 |
| 63 | 0 | -1 | 0 | -1 | 0 | -1 | 0 | -1 | -1 | -1 | -1 |
| 64 | 0 | -1 | 0 | -1 | 0 | -1 | 0 | -1 | -1 | -1 | -1 |
| 65 | 0 | -1 | 0 | -1 | 0 | -1 | 0 | -1 | -1 | -1 | -1 |
| 66 | 0 | -1 | 0 | -1 | 0 | -1 | 0 | -1 | -1 | -1 | -1 |
| 67 | 0 | -1 | 0 | -1 | 0 | -1 | 0 | -1 | -1 | -1 | -1 |
| 68 | 0 | -1 | 0 | -1 | 0 | -1 | 0 | -1 | -1 | -1 | -1 |
| 69 | 0 | -1 | 0 | -1 | 0 | -1 | 0 | -1 | -1 | -1 | -1 |
| 70 | 0 | -1 | 0 | -1 | 0 | -1 | 0 | -1 | -1 | -1 | -1 |
| 71 | 0 | -1 | 0 | -1 | 0 | -1 | 0 | -1 | -1 | -1 | -1 |
| 72 | 0 | -1 | 0 | -1 | 0 | -1 | 0 | -1 | -1 | -1 | -1 |
| 73 | 0 | -1 | 0 | -1 | 0 | -1 | 0 | -1 | -1 | -1 | -1 |
| 74 | 0 | -1 | 0 | -1 | 0 | -1 | 0 | -1 | -1 | -1 | -1 |
| 75 | 0 | -1 | 0 | -1 | 0 | -1 | 0 | -1 | -1 | -1 | -1 |
| 76 | 0 | -1 | 0 | -1 | 0 | -1 | 0 | -1 | -1 | -1 | -1 |
| 77 | 0 | -1 | 0 | -1 | 0 | -1 | 0 | -1 | -1 | -1 | -1 |
| 78 | 0 | -1 | 0 | -1 | 0 | -1 | 0 | -1 | -1 | -1 | -1 |
| 79 | 0 | -1 | 0 | -1 | 0 | -1 | 0 | -1 | -1 | -1 | -1 |
| 80 | 0 | -1 | 0 | -1 | 0 | -1 | 0 | -1 | -1 | -1 | -1 |
| 81 | 0 | -1 | 0 | -1 | 0 | -1 | 0 | -1 | -1 | -1 | -1 |
| 82 | 0 | -1 | 0 | -1 | 0 | -1 | 0 | -1 | -1 | -1 | -1 |
| 83 | 0 | -1 | 0 | -1 | 0 | -1 | 0 | -1 | -1 | -1 | -1 |
| 84 | 0 | -1 | 0 | -1 | 0 | -1 | 0 | -1 | -1 | -1 | -1 |
| 85 | 0 | -1 | 0 | -1 | 0 | -1 | 0 | -1 | -1 | -1 | -1 |
| 86 | 0 | -1 | 0 | -1 | 0 | -1 | 0 | -1 | -1 | -1 | -1 |
| 87 | 0 | -1 | 0 | -1 | 0 | -1 | 0 | -1 | -1 | -1 | -1 |
| 88 | 0 | -1 | 0 | -1 | 0 | -1 | 0 | -1 | -1 | -1 | -1 |
| 89 | 0 | -1 | 0 | -1 | 0 | -1 | 0 | -1 | -1 | -1 | -1 |
| 90 | 0 | -1 | 0 | -1 | 0 | -1 | 0 | -1 | -1 | -1 | -1 |
| 91 | 0 | -1 | 0 | -1 | 0 | -1 | 0 | -1 | -1 | -1 | -1 |
| 92 | 0 | -1 | 0 | -1 | 0 | -1 | 0 | -1 | -1 | -1 | -1 |
| 93 | 0 | -1 | 0 | -1 | 0 | -1 | 0 | -1 | -1 | -1 | -1 |
| 94 | 0 | -1 | 0 | -1 | 0 | -1 | 0 | -1 | -1 | -1 | -1 |
| 95 | 0 | -1 | 0 | -1 | 0 | -1 | 0 | -1 | -1 | -1 | -1 |
| 96 | 0 | -1 | 0 | -1 | 0 | -1 | 0 | -1 | -1 | -1 | -1 |
| 97 | 0 | -1 | 0 | -1 | 0 | -1 | 0 | -1 | -1 | -1 | -1 |
| 98 | 0 | -1 | 0 | -1 | 0 | -1 | 0 | -1 | -1 | -1 | -1 |
| 99 | 0 | -1 | 0 | -1 | 0 | -1 | 0 | -1 | -1 | -1 | -1 |
| 100 | 0 | -1 | 0 | -1 | 0 | -1 | 0 | -1 | -1 | -1 | -1 |

FIG. 17B

| | pos in | neg in | COMBINED AMPLITUDE AND DUTY CYCLE CONTROL | | | | | | | | |
|---|---|---|---|---|---|---|---|---|---|---|---|
| "Time" | | | EQUAL | | SHIFTED POSITIVE | | SHIFTED NEGATIVE | | EQ | POS | NEG |
| | | | POS | NEG | POS | NEG | POS | NEG | SUM | SUM | SUM |
| 1 | 1 | 0 | 1 | 0 | 1.2 | 0 | 0.8 | 0 | 1 | 1.2 | 0.8 |
| 2 | 1 | 0 | 1 | 0 | 1.2 | 0 | 0.8 | 0 | 1 | 1.2 | 0.8 |
| 3 | 1 | 0 | 1 | 0 | 1.2 | 0 | 0.8 | 0 | 1 | 1.2 | 0.8 |
| 4 | 1 | 0 | 1 | 0 | 1.2 | 0 | 0.8 | 0 | 1 | 1.2 | 0.8 |
| 5 | 1 | 0 | 1 | 0 | 1.2 | 0 | 0.8 | 0 | 1 | 1.2 | 0.8 |
| 6 | 1 | 0 | 1 | 0 | 1.2 | 0 | 0.8 | 0 | 1 | 1.2 | 0.8 |
| 7 | 1 | 0 | 1 | 0 | 1.2 | 0 | 0.8 | 0 | 1 | 1.2 | 0.8 |
| 8 | 1 | 0 | 1 | 0 | 1.2 | 0 | 0.8 | 0 | 1 | 1.2 | 0.8 |
| 9 | 1 | 0 | 1 | 0 | 1.2 | 0 | 0.8 | 0 | 1 | 1.2 | 0.8 |
| 10 | 1 | 0 | 1 | 0 | 1.2 | 0 | 0.8 | 0 | 1 | 1.2 | 0.8 |
| 11 | 1 | 0 | 1 | 0 | 1.2 | 0 | 0.8 | 0 | 1 | 1.2 | 0.8 |
| 12 | 1 | 0 | 1 | 0 | 1.2 | 0 | 0.8 | 0 | 1 | 1.2 | 0.8 |
| 13 | 1 | 0 | 1 | 0 | 1.2 | 0 | 0.8 | 0 | 1 | 1.2 | 0.8 |
| 14 | 1 | 0 | 1 | 0 | 1.2 | 0 | 0.8 | 0 | 1 | 1.2 | 0.8 |
| 15 | 1 | 0 | 1 | 0 | 1.2 | 0 | 0.8 | 0 | 1 | 1.2 | 0.8 |
| 16 | 1 | 0 | 1 | 0 | 1.2 | 0 | 0.8 | 0 | 1 | 1.2 | 0.8 |
| 17 | 1 | 0 | 1 | 0 | 1.2 | 0 | 0.8 | 0 | 1 | 1.2 | 0.8 |
| 18 | 1 | 0 | 1 | 0 | 1.2 | 0 | 0.8 | 0 | 1 | 1.2 | 0.8 |
| 19 | 1 | 0 | 1 | 0 | 1.2 | 0 | 0.8 | 0 | 1 | 1.2 | 0.8 |
| 20 | 1 | 0 | 1 | 0 | 1.2 | 0 | 0.8 | 0 | 1 | 1.2 | 0.8 |
| 21 | 1 | 0 | 1 | 0 | 1.2 | 0 | 0.8 | 0 | 1 | 1.2 | 0.8 |
| 22 | 1 | 0 | 1 | 0 | 1.2 | 0 | 0.8 | 0 | 1 | 1.2 | 0.8 |
| 23 | 1 | 0 | 1 | 0 | 1.2 | 0 | 0.8 | 0 | 1 | 1.2 | 0.8 |
| 24 | 1 | 0 | 1 | 0 | 1.2 | 0 | 0.8 | 0 | 1 | 1.2 | 0.8 |
| 25 | 1 | 0 | 1 | 0 | 1.2 | 0 | 0.8 | 0 | 1 | 1.2 | 0.8 |
| 26 | 1 | 0 | 1 | 0 | 1.2 | 0 | 0.8 | 0 | 1 | 1.2 | 0.8 |
| 27 | 1 | 0 | 1 | 0 | 1.2 | 0 | 0.8 | 0 | 1 | 1.2 | 0.8 |
| 28 | 1 | 0 | 1 | 0 | 1.2 | 0 | 0.8 | 0 | 1 | 1.2 | 0.8 |
| 29 | 1 | 0 | 1 | 0 | 1.2 | 0 | 0.8 | 0 | 1 | 1.2 | 0.8 |
| 30 | 1 | 0 | 1 | 0 | 1.2 | 0 | 0.8 | 0 | 1 | 1.2 | 0.8 |
| 31 | 1 | 0 | 1 | 0 | 1.2 | 0 | 0.8 | 0 | 1 | 1.2 | 0.8 |
| 32 | 1 | 0 | 1 | 0 | 1.2 | 0 | 0.8 | 0 | 1 | 1.2 | 0.8 |
| 33 | 1 | 0 | 1 | 0 | 1.2 | 0 | 0.8 | 0 | 1 | 1.2 | 0.8 |
| 34 | 1 | 0 | 1 | 0 | 1.2 | 0 | 0.8 | 0 | 1 | 1.2 | 0.8 |
| 35 | 1 | 0 | 1 | 0 | 1.2 | 0 | 0.8 | 0 | 1 | 1.2 | 0.8 |
| 36 | 1 | 0 | 1 | 0 | 1.2 | 0 | 0.8 | 0 | 1 | 1.2 | 0.8 |
| 37 | 1 | 0 | 1 | 0 | 1.2 | 0 | 0.8 | 0 | 1 | 1.2 | 0.8 |
| 38 | 1 | 0 | 1 | 0 | 1.2 | 0 | 0.8 | 0 | 1 | 1.2 | 0.8 |
| 39 | 1 | 0 | 1 | 0 | 1.2 | 0 | 0.8 | 0 | 1 | 1.2 | 0.8 |
| 40 | 1 | 0 | 1 | 0 | 1.2 | 0 | 0 | -1.2 | 1 | 1.2 | -1.2 |
| 41 | 1 | 0 | 1 | 0 | 1.2 | 0 | 0 | -1.2 | 1 | 1.2 | -1.2 |
| 42 | 1 | 0 | 1 | 0 | 1.2 | 0 | 0 | -1.2 | 1 | 1.2 | -1.2 |
| 43 | 1 | 0 | 1 | 0 | 1.2 | 0 | 0 | -1.2 | 1 | 1.2 | -1.2 |
| 44 | 1 | 0 | 1 | 0 | 1.2 | 0 | 0 | -1.2 | 1 | 1.2 | -1.2 |
| 45 | 1 | 0 | 1 | 0 | 1.2 | 0 | 0 | -1.2 | 1 | 1.2 | -1.2 |
| 46 | 1 | 0 | 1 | 0 | 1.2 | 0 | 0 | -1.2 | 1 | 1.2 | -1.2 |
| 47 | 1 | 0 | 1 | 0 | 1.2 | 0 | 0 | -1.2 | 1 | 1.2 | -1.2 |
| 48 | 1 | 0 | 1 | 0 | 1.2 | 0 | 0 | -1.2 | 1 | 1.2 | -1.2 |
| 49 | 1 | 0 | 1 | 0 | 1.2 | 0 | 0 | -1.2 | 1 | 1.2 | -1.2 |
| 50 | 1 | 0 | 1 | 0 | 1.2 | 0 | 0 | -1.2 | 1 | 1.2 | -1.2 |

FIG. 18A

| | pos In | neg In | COMBINED AMPLITUDE AND DUTY CYCLE CONTROL | | | | | | | | |
|---|---|---|---|---|---|---|---|---|---|---|---|
| "Time" | | | EQUAL | | SHIFTED POSITIVE | | SHIFTED NEGATIVE | | EQ | POS | NEG |
| | | | POS | NEG | POS | NEG | POS | NEG | SUM | SUM | SUM |
| 51 | 0 | -1 | 0 | -1 | 1.2 | 0 | 0 | -1.2 | -1 | 1.2 | -1.2 |
| 52 | 0 | -1 | 0 | -1 | 1.2 | 0 | 0 | -1.2 | -1 | 1.2 | -1.2 |
| 53 | 0 | -1 | 0 | -1 | 1.2 | 0 | 0 | -1.2 | -1 | 1.2 | -1.2 |
| 54 | 0 | -1 | 0 | -1 | 1.2 | 0 | 0 | -1.2 | -1 | 1.2 | -1.2 |
| 55 | 0 | -1 | 0 | -1 | 1.2 | 0 | 0 | -1.2 | -1 | 1.2 | -1.2 |
| 56 | 0 | -1 | 0 | -1 | 1.2 | 0 | 0 | -1.2 | -1 | 1.2 | -1.2 |
| 57 | 0 | -1 | 0 | -1 | 1.2 | 0 | 0 | -1.2 | -1 | 1.2 | -1.2 |
| 58 | 0 | -1 | 0 | -1 | 1.2 | 0 | 0 | -1.2 | -1 | 1.2 | -1.2 |
| 59 | 0 | -1 | 0 | -1 | 1.2 | 0 | 0 | -1.2 | -1 | 1.2 | -1.2 |
| 60 | 0 | -1 | 0 | -1 | 1.2 | 0 | 0 | -1.2 | -1 | 1.2 | -1.2 |
| 61 | 0 | -1 | 0 | -1 | 0 | -0.8 | 0 | -1.2 | -1 | -0.8 | -1.2 |
| 62 | 0 | -1 | 0 | -1 | 0 | -0.8 | 0 | -1.2 | -1 | -0.8 | -1.2 |
| 63 | 0 | -1 | 0 | -1 | 0 | -0.8 | 0 | -1.2 | -1 | -0.8 | -1.2 |
| 64 | 0 | -1 | 0 | -1 | 0 | -0.8 | 0 | -1.2 | -1 | -0.8 | -1.2 |
| 65 | 0 | -1 | 0 | -1 | 0 | -0.8 | 0 | -1.2 | -1 | -0.8 | -1.2 |
| 66 | 0 | -1 | 0 | -1 | 0 | -0.8 | 0 | -1.2 | -1 | -0.8 | -1.2 |
| 67 | 0 | -1 | 0 | -1 | 0 | -0.8 | 0 | -1.2 | -1 | -0.8 | -1.2 |
| 68 | 0 | -1 | 0 | -1 | 0 | -0.8 | 0 | -1.2 | -1 | -0.8 | -1.2 |
| 69 | 0 | -1 | 0 | -1 | 0 | -0.8 | 0 | -1.2 | -1 | -0.8 | -1.2 |
| 70 | 0 | -1 | 0 | -1 | 0 | -0.8 | 0 | -1.2 | -1 | -0.8 | -1.2 |
| 71 | 0 | -1 | 0 | -1 | 0 | -0.8 | 0 | -1.2 | -1 | -0.8 | -1.2 |
| 72 | 0 | -1 | 0 | -1 | 0 | -0.8 | 0 | -1.2 | -1 | -0.8 | -1.2 |
| 73 | 0 | -1 | 0 | -1 | 0 | -0.8 | 0 | -1.2 | -1 | -0.8 | -1.2 |
| 74 | 0 | -1 | 0 | -1 | 0 | -0.8 | 0 | -1.2 | -1 | -0.8 | -1.2 |
| 75 | 0 | -1 | 0 | -1 | 0 | -0.8 | 0 | -1.2 | -1 | -0.8 | -1.2 |
| 76 | 0 | -1 | 0 | -1 | 0 | -0.8 | 0 | -1.2 | -1 | -0.8 | -1.2 |
| 77 | 0 | -1 | 0 | -1 | 0 | -0.8 | 0 | -1.2 | -1 | -0.8 | -1.2 |
| 78 | 0 | -1 | 0 | -1 | 0 | -0.8 | 0 | -1.2 | -1 | -0.8 | -1.2 |
| 79 | 0 | -1 | 0 | -1 | 0 | -0.8 | 0 | -1.2 | -1 | -0.8 | -1.2 |
| 80 | 0 | -1 | 0 | -1 | 0 | -0.8 | 0 | -1.2 | -1 | -0.8 | -1.2 |
| 81 | 0 | -1 | 0 | -1 | 0 | -0.8 | 0 | -1.2 | -1 | -0.8 | -1.2 |
| 82 | 0 | -1 | 0 | -1 | 0 | -0.8 | 0 | -1.2 | -1 | -0.8 | -1.2 |
| 83 | 0 | -1 | 0 | -1 | 0 | -0.8 | 0 | -1.2 | -1 | -0.8 | -1.2 |
| 84 | 0 | -1 | 0 | -1 | 0 | -0.8 | 0 | -1.2 | -1 | -0.8 | -1.2 |
| 85 | 0 | -1 | 0 | -1 | 0 | -0.8 | 0 | -1.2 | -1 | -0.8 | -1.2 |
| 86 | 0 | -1 | 0 | -1 | 0 | -0.8 | 0 | -1.2 | -1 | -0.8 | -1.2 |
| 87 | 0 | -1 | 0 | -1 | 0 | -0.8 | 0 | -1.2 | -1 | -0.8 | -1.2 |
| 88 | 0 | -1 | 0 | -1 | 0 | -0.8 | 0 | -1.2 | -1 | -0.8 | -1.2 |
| 89 | 0 | -1 | 0 | -1 | 0 | -0.8 | 0 | -1.2 | -1 | -0.8 | -1.2 |
| 90 | 0 | -1 | 0 | -1 | 0 | -0.8 | 0 | -1.2 | -1 | -0.8 | -1.2 |
| 91 | 0 | -1 | 0 | -1 | 0 | -0.8 | 0 | -1.2 | -1 | -0.8 | -1.2 |
| 92 | 0 | -1 | 0 | -1 | 0 | -0.8 | 0 | -1.2 | -1 | -0.8 | -1.2 |
| 93 | 0 | -1 | 0 | -1 | 0 | -0.8 | 0 | -1.2 | -1 | -0.8 | -1.2 |
| 94 | 0 | -1 | 0 | -1 | 0 | -0.8 | 0 | -1.2 | -1 | -0.8 | -1.2 |
| 95 | 0 | -1 | 0 | -1 | 0 | -0.8 | 0 | -1.2 | -1 | -0.8 | -1.2 |
| 96 | 0 | -1 | 0 | -1 | 0 | -0.8 | 0 | -1.2 | -1 | -0.8 | -1.2 |
| 97 | 0 | -1 | 0 | -1 | 0 | -0.8 | 0 | -1.2 | -1 | -0.8 | -1.2 |
| 98 | 0 | -1 | 0 | -1 | 0 | -0.8 | 0 | -1.2 | -1 | -0.8 | -1.2 |
| 99 | 0 | -1 | 0 | -1 | 0 | -0.8 | 0 | -1.2 | -1 | -0.8 | -1.2 |
| 100 | 0 | -1 | 0 | -1 | 0 | -0.8 | 0 | -1.2 | -1 | -0.8 | -1.2 |

FIG. 18B

BASELINE VALUES

| | | OUTPUT LEVEL | | UPPER LIMIT | | LOWER LIMIT | | | |
|---|---|---|---|---|---|---|---|---|---|
| Mode | Freq | Pos Amp (kV) | Neg Amp (kV) | Pos Limit (kV) | Neg Limit (kV) | Pos Limit (kV) | Neg Limit (kV) | Amp Resolution | Time Resolution |
| SPEED | 45HZ | 7 | -7 | 13 | 13 | 3.5 | 3.5 | 14BIT | 50uSEC |
| HYBRID | 15HZ | 9 | -9 | 18 | 18 | 3.5 | 3.5 | 14BIT | 50uSEC |
| DISTANCE | 7.5HZ | 12 | -12 | 18 | 18 | 3.5 | 3.5 | 14BIT | 50uSEC |

FIG. 21

MULTIPLE-AXIS CONTROL APPARATUS FOR IONIZATION SYSTEMS

CROSS REFERENCE TO RELATED APPLICATIONS

This application claims the benefit of U.S. Provisional Patent Application No. 61/003,733, filed on Nov. 19, 2007, entitled "Multiple-Axis Control Method And Apparatus For Ionization Systems," the entire contents of which is incorporated by reference herein.

BACKGROUND OF THE INVENTION

Direct current (DC), pulse, or alternating current (AC) ionization systems having high voltage power supplies and an ionizer typically employ one of two methods to control the balance or net charge of the target area. Amplitude control adjusts the relative amplitudes of positive and negative ionization. This can be achieved through adjustment of either the current or the voltage being applied to the ionizer.

Duty cycle control can also be used to control the balance or net charge of the target area. In this type of control, adjustments to the positive and negative ionization cycles are made relative to the time axis. Control is achieved by lengthening or shortening the relative duty cycle of the positive and negative ionization.

For the purposes of neutralization and/or balance, adjustments to pulse frequency and waveform shape may also be employed. High voltage pulse frequency may be adjusted up or down for control. Techniques to optimize the exact shape of the output pulses may also be employed. Adjustments to such parameters are made to optimize performance.

It is desirable to provide a control method that increases the dynamic range of ionizer control relative to the target area, particularly in applications where the ionizer is close to highly charged objects, such as a moving web or other insulators. It is further desirable to enhance the resolution of either control technique.

BRIEF SUMMARY OF THE INVENTION

Briefly stated, an embodiment of the present invention comprises a bipolar ionization apparatus that includes a positive high voltage power supply having an output with at least one positive ion emitting electrode connected thereto and configured to generate positive ions. A negative high voltage power supply has an output with at least one negative ion emitting electrode connected thereto and is configured to generate negative ions. A controller for an ionizer outputs a positive high voltage ionization waveform and a negative high voltage ionization waveform. The controller simultaneously adjusts an amplitude and a duty cycle of each of the waveforms.

Another embodiment of the present invention comprises a bipolar ionization apparatus that includes a positive high voltage power supply having an output with at least one positive ion emitting electrode connected thereto and configured to generate positive ions. A negative high voltage power supply has an output with at least one negative ion emitting electrode connected thereto and is configured to generate negative ions. A controller is configured to simultaneously adjust an amplitude and a duty cycle of each of the outputs of the positive and negative high voltage power supplies.

Still another embodiment of the present invention comprises a bipolar ionization apparatus that includes a positive high voltage power supply having an output with at least one positive ion emitting electrode connected thereto and configured to generate positive ions. A negative high voltage power supply has an output with at least one negative ion emitting electrode connected thereto and is configured to generate negative ions. Each of the outputs of the positive and negative high voltage power supplies has an amplitude and a duty cycle. A controller is configured to selectively adjust at least one of the amplitude and the duty cycle of the outputs of the positive and negative high voltage power supplies.

A further embodiment of the present invention comprises a bipolar ionization apparatus that includes a bipolar high voltage power supply having at least one output with at least one ion emitting electrode connected thereto. The bipolar high voltage power supply alternately outputs positive and negative potential. The ion emitting electrode thereby alternately generates positive and negative ions. A controller is configured to simultaneously adjust an amplitude and a duty cycle of the output of the bipolar high voltage power supply.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIGS. 16A and 16B, taken together, show a table of values used to create the graphs of FIGS. 4, 7, 10, and 13;

FIGS. 17A and 17B, taken together, show a table of values used to create the graphs of FIGS. 5,8, 11, and 14;

FIGS. 18A and 18B, taken together, show a table of values used to create the graphs of FIGS. 6, 9, 12, and 15;

FIG. 21 is a table of the baseline values of a plurality of modes of the ionization system in accordance with preferred embodiments of the present invention;

DETAILED DESCRIPTION OF THE INVENTION

Figure 1:
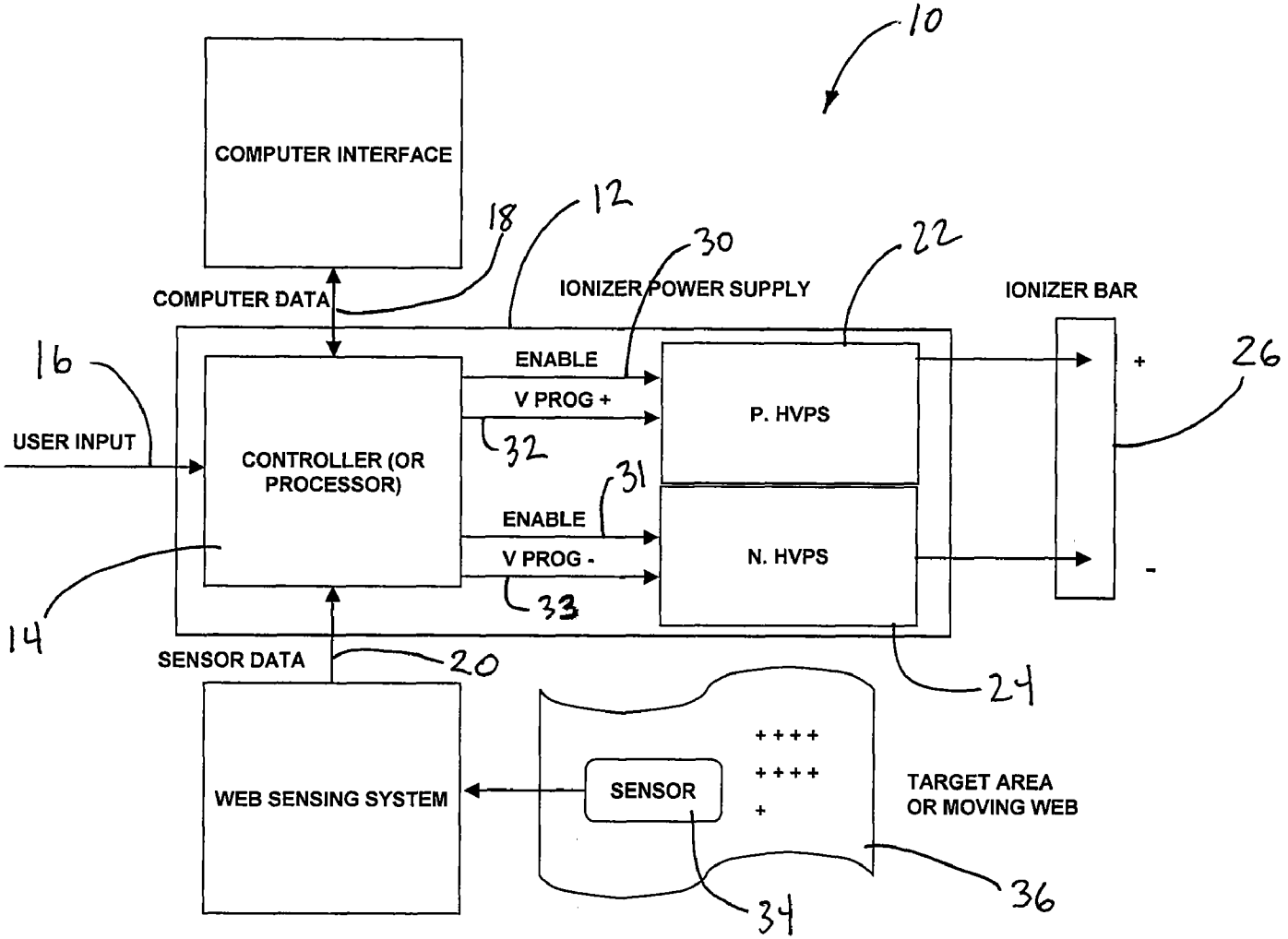
FIG. 1 is a schematic block diagram of a bipolar pulse ionization system.

Certain terminology is used herein for convenience only and is not to be taken as a limitation on the present invention. In the drawings, the same reference numbers are employed for designating the same elements throughout the several figures.

Dual-axis control combines positive and negative amplitude and duty cycle control and applies these controls to the ionizer simultaneously. The result of this control method is a greatly increased dynamic range of ionizer control relative to the target area. This is particularly useful in application where the ionizer is close to highly charged objects, such as a moving web or other insulators. Another benefit of combining amplitude and duty cycle control is enhanced resolution relative to either technique used alone. Because the controller also has the ability to adjust output pulse frequency and waveform shape, these parameters may also be combined with amplitude and frequency to allow multi-axis control.

In a preferred embodiment, dual axis control can be steered using sensors that indicate residual charge on the target. These sensors are located downstream from the ionizer. The ionizer uses the sensor information to simultaneously adjust the amplitude and the duty cycle of the ionizer to eliminate the downstream charge. Referring now to the attached figures, for the purpose of illustrating the invention, there are shown in the drawings, embodiments which are presently preferred. It should be understood, however, that the invention is not limited to the precise arrangements and instrumentalities shown.

FIG. 1 is a schematic block diagram of a bipolar pulse ionization system. In this preferred embodiment, input is received into a bipolar ionization apparatus 10. In FIG. 1, the input is received by an ionization power supply 12. The input may be introduced from a plurality of sources including, but not limited to, user input 16, sensor input 20, microprocessor input, computer input 18, or the like. In a preferred embodiment, the input is received by a controller, processor, or other controlling circuitry 14 (for simplicity, hereinafter referred to as "controller 14"). Various high voltage generating topologies can be used in the preferred embodiments of the present invention. In particular, various controllers 14, such as microcontrollers or microprocessors, can be used in the application of the preferred embodiments of the present invention. One suitable controller 14 is the commercially available Z8 Encore microprocessor manufactured by Zilog, Inc.

In this preferred embodiment, the controller 14 is coupled to a positive high voltage (HV) power supply 22 and a negative HV power supply 24, which in turn supply input power to an ionization emitter 26, shown in FIG. 1 as an ionizer bar 26.

In this preferred embodiment, the controller 14 is used to provide the frequency response required for the pulse application and desired frequencies. Enable signals 30, 31 are provided to the positive and negative HV power supplies 22, 24 respectively to set the timing of high voltage pulses. Vprog+ and Vprog− signals 32, 33 set the output level. A sensor 34 collects data about neutralization of a target area 36. As described above, the apparatus 10 is responsive to user input 16, computer input 18, sensor input 20, or other inputs.

Figure 2A:
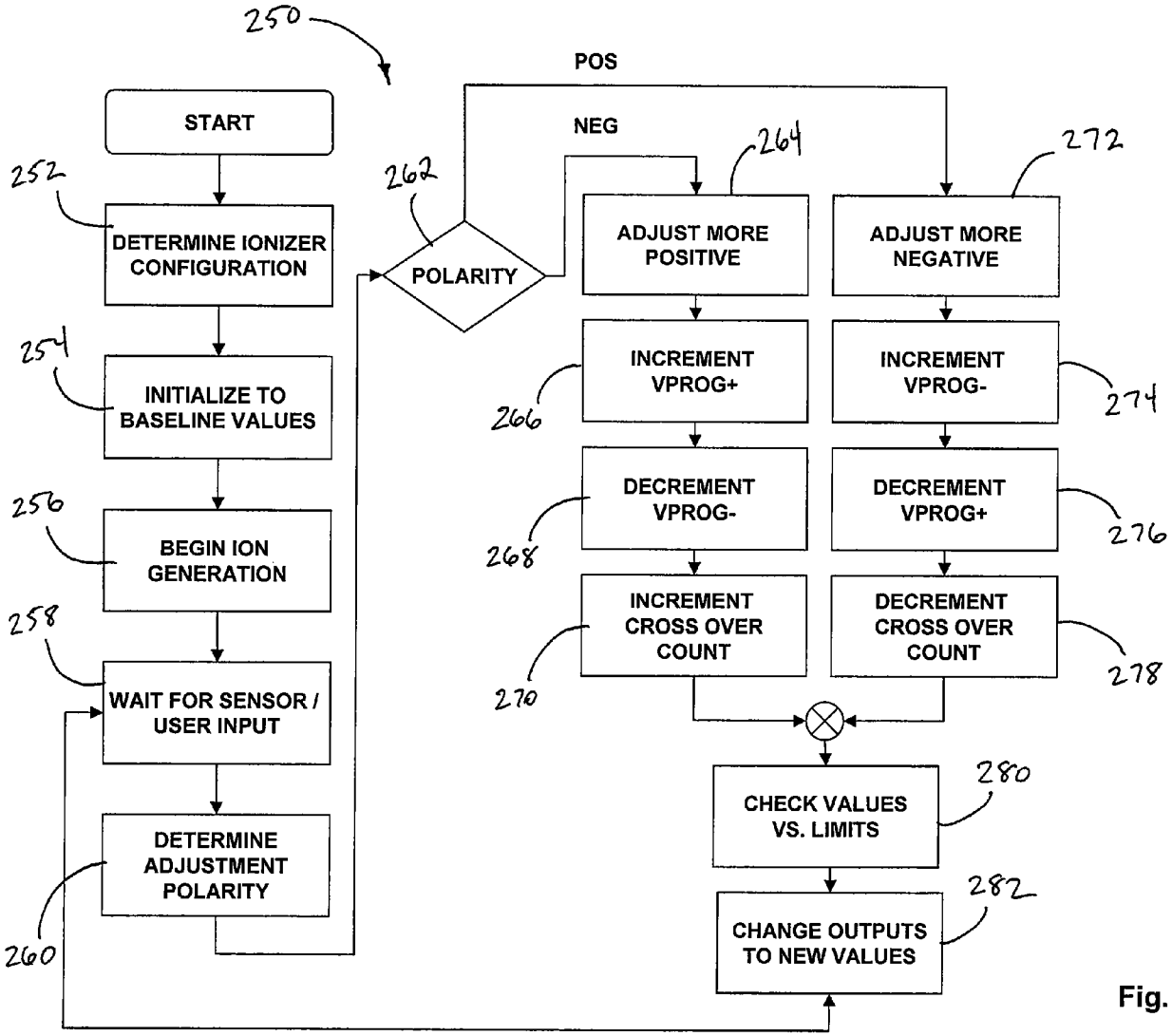
FIG. 2A is a flowchart illustrating an adjustment program for the system of FIG. 1.

FIG. 2A is a flowchart illustrating an adjustment program 250 for an ionization system in accordance with a preferred embodiment of the present invention. Once the configuration of the ionizer 16 is determined (step 252), the apparatus 10 is initialized to baseline values (step 254), and ion generation begins (step 256), the main loop of the adjustment program 250 is entered. The effect of dual axis control in the target area 36 is that a greater range of charge levels can be neutralized than by using either the amplitude or duty cycle controls alone. As shown in FIG. 2, the amplitude and duty cycle controls are adjusted simultaneously and applied to the ionizer 16. The adjustments to the polarity occur simultaneously. By way of example, upon receipt of the sensor, user, or microprocessor input (step 258), a determination is made (step 260) regarding whether adjustment to the polarity is required. Upon determination that the polarity needs to be adjusted (step 260), the adjustments of amplitude and duty control are made simultaneously. If it is determined that the negative polarity (step 262) needs to be adjusted to be more positive (step 264), the following adjustments are made simultaneously: (1) an increment is made to the Vprog+ (step 266), (2) a decrement is made to the Vprog− (step 268), and (3) an increment is made to the timing at the cross over counter (step 270). Once the variables have been adjusted, check values are compared to a set of limit values (step 280). If the check values are within the limit values, the outputs are changed to new values that correspond to the check values (step 282). If it is determined that the positive polarity (step 262) needs to be adjusted to be more negative (step 272), the following adjustments are made simultaneously: (1) an increment is made to the Vprog− (step 274), (2) a decrement is made to the Vprog+ (step 276), and (3) a decrement is made to the timing at the cross over counter (step 278). Once the variables have been adjusted, check values are compared to a set of limit values (step 280). If the check values are within the limit values the outputs are changed to new values that correspond to the check values (step 282). This process is repeated until the desired polarity is obtained. Control of the balance or the net charge of the target area 36 is achieved by the adjustments to the positive and negative ionization cycles relative to time and by the lengthening and/or shortening of the duty cycles of the positive and negative ionization. Such simultaneous adjustment of the amplitude and duty cycle variables results in a greater effect then the application of either variable individually.

Figure 2B:
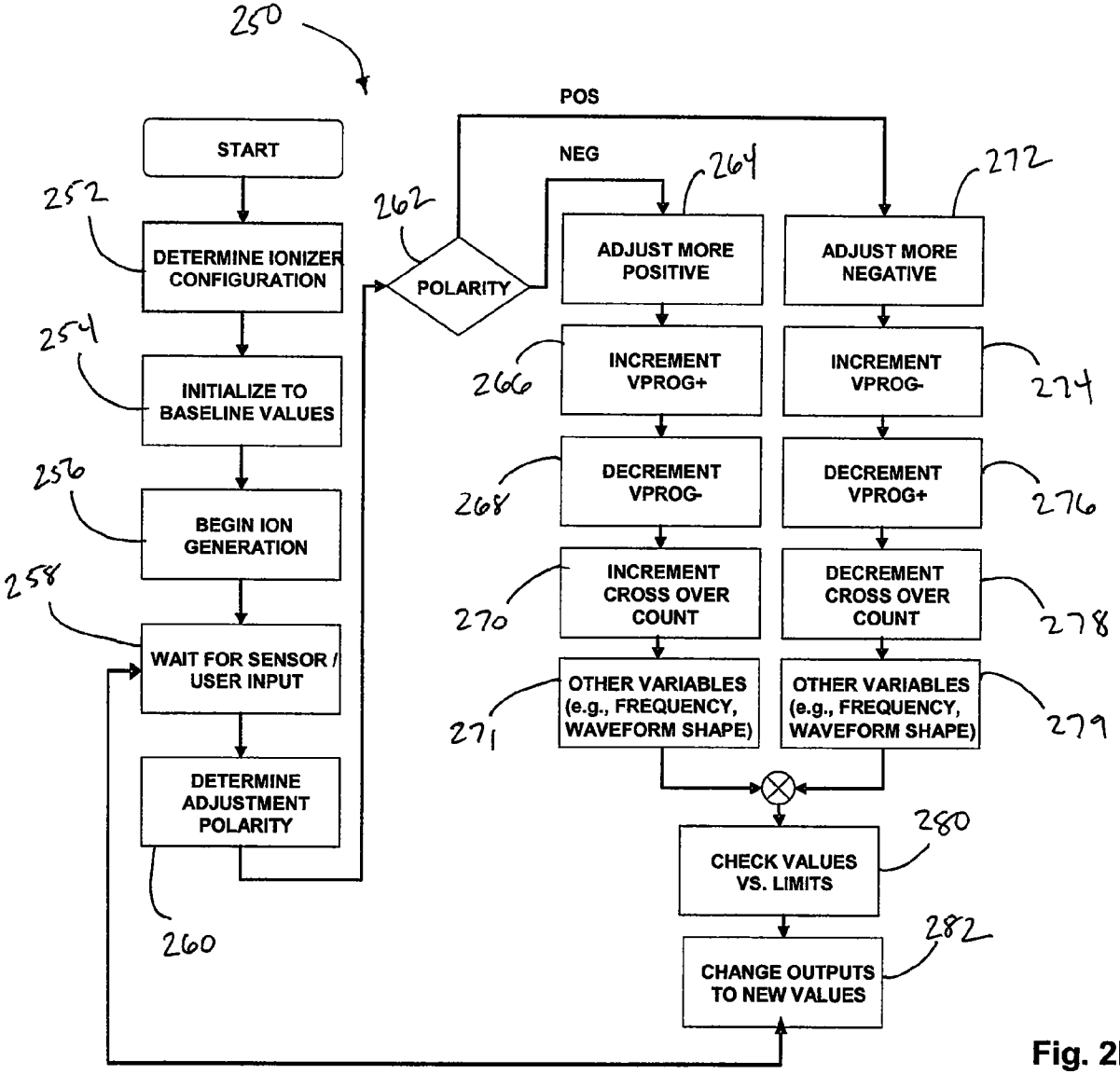
FIG. 2B is a flowchart illustrating an alternate adjustment program for the system of FIG. 1.

Other adjustment variables supported by the controller 14, such as pulse frequency and waveform shape may optionally be added in the algorithm of FIG. 2A, such as steps 271, 279 shown in FIG. 2B. Adjustment of these additional variables in combination with the amplitude and the duty cycle provide even greater resolution of ion generation.

Figure 3A:
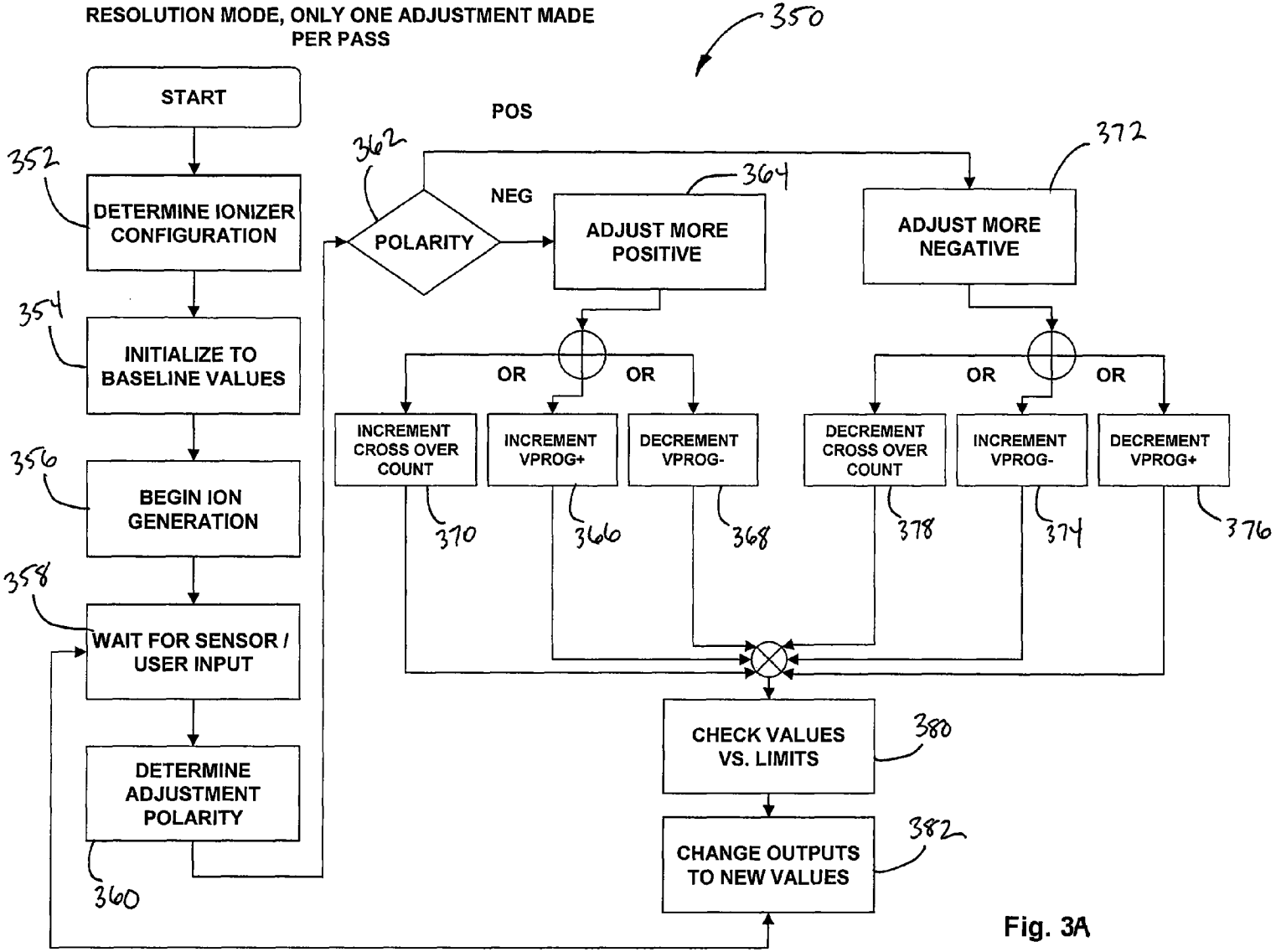
FIG. 3A is a flowchart illustrating a second adjustment program for the system of FIG. 1.

FIG. 3A is a flowchart illustrating another adjustment program 350 for an ionization system in accordance with a preferred embodiment of the present invention. Similar to the steps in FIG. 2, the ionizer configuration is determined (step 352), and the system is initialized to a baseline set of values for the ionizer selected (step 354). Ion generation is begun (step 356), input from a user, sensor, or microprocessor is received (step 358). A determination is made (step 360) as to whether adjustment of the polarity of the ionizer is required. In this preferred embodiment, the adjustments are processed as individual steps, for example, if it is determined that the negative polarity (step 362) needs to be adjusted to be more positive (step 364), one or more of the following steps is processed: (1) an increment to the timing of the cross over counter is made (step 370), or (2) an increment to the Vprog+ is made (step 366), or (3) a decrement to the Vprog− is made (step 368). The adjustments are made in this manner to enhance and increase the resolution. As shown in FIG. 3, if the positive polarity (step 362) needs to be adjusted to be more negative (step 372), one or more of the following steps is processed: (1) a decrement to the timing of the cross over counter is made (step 378), or (2) increment to the Vprog− is made (step 374), or (3) a decrement to the Vprog+ is made (step 376). As shown in FIG. 3, the check values after the polarity has been adjusted are compared to a set of limit values (step 380). If the check values are within the limit values the outputs are changed to new values that correspond to the check values (step 382). This process is repeated until the desired polarity is obtained. The outputs are sent to the ionization power supply 12 as inputs and the process is repeated as necessary. Further resolution is provided by the embodiment shown in FIG. 3A as opposed to the simultaneous adjustment technique of FIG. 2.

Figure 3B:
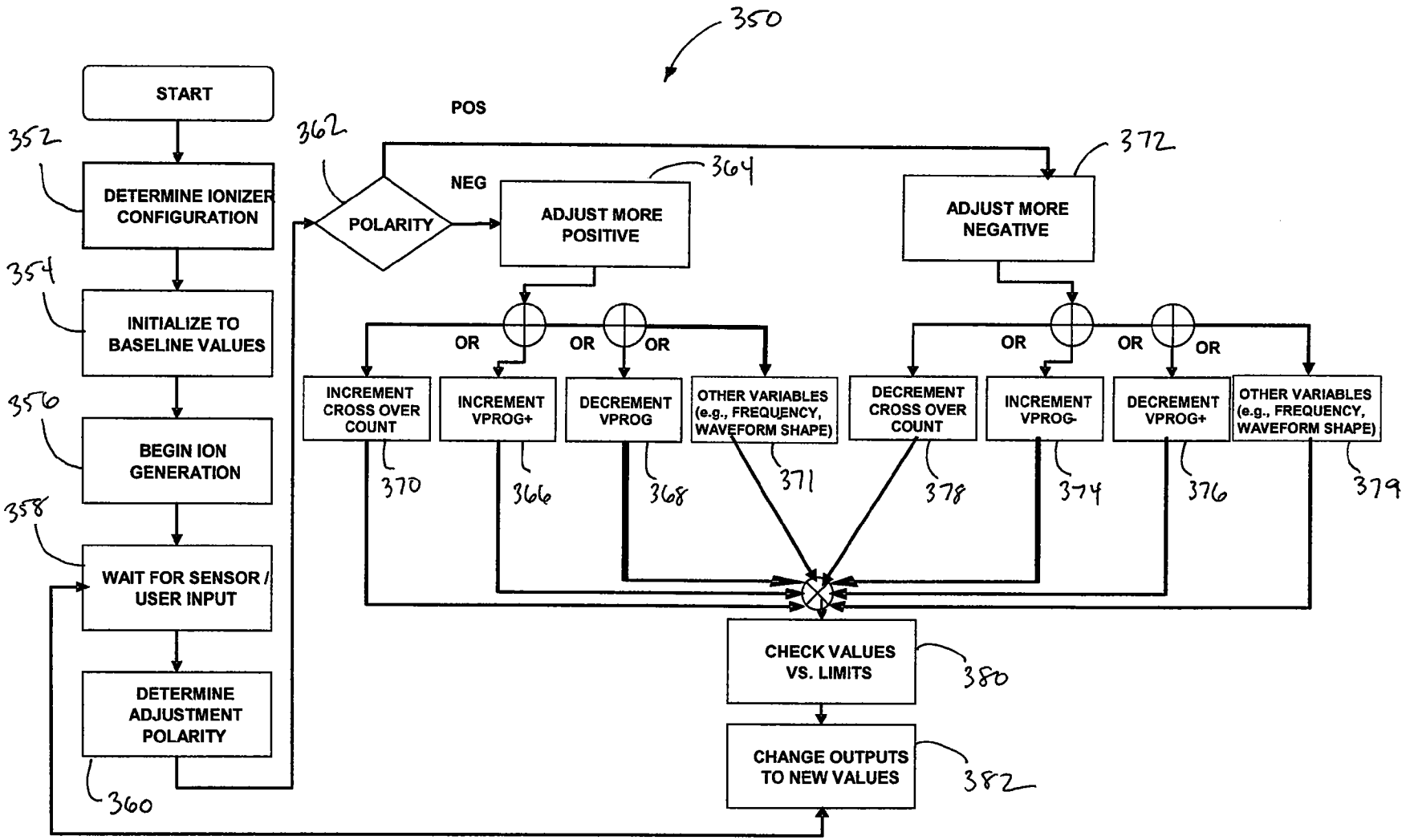
FIG. 3B is a flowchart illustrating an alternate second adjustment program for the system of FIG. 1.

Other adjustment variables supported by the controller 14, such as pulse frequency and waveform shape may optionally be added in the algorithm of FIG. 3A, such as steps 371, 379 shown in FIG. 3B. Adjustment of these additional variables in combination with the amplitude and the duty cycle provide even greater resolution of ion generation.

Figure 4:
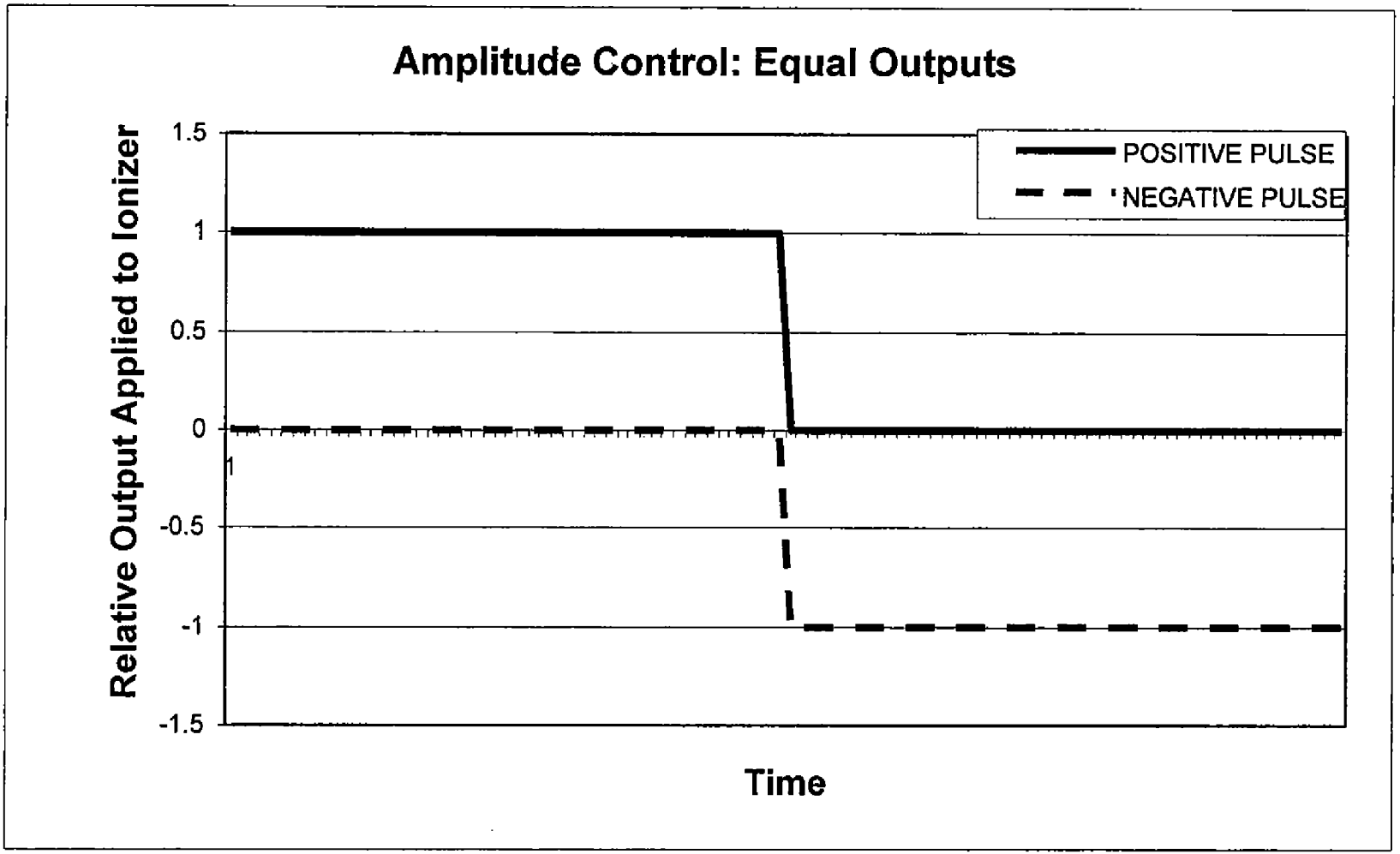
FIG. 4 is a graph showing pulses under amplitude control for the case of equal output.
Figure 5:
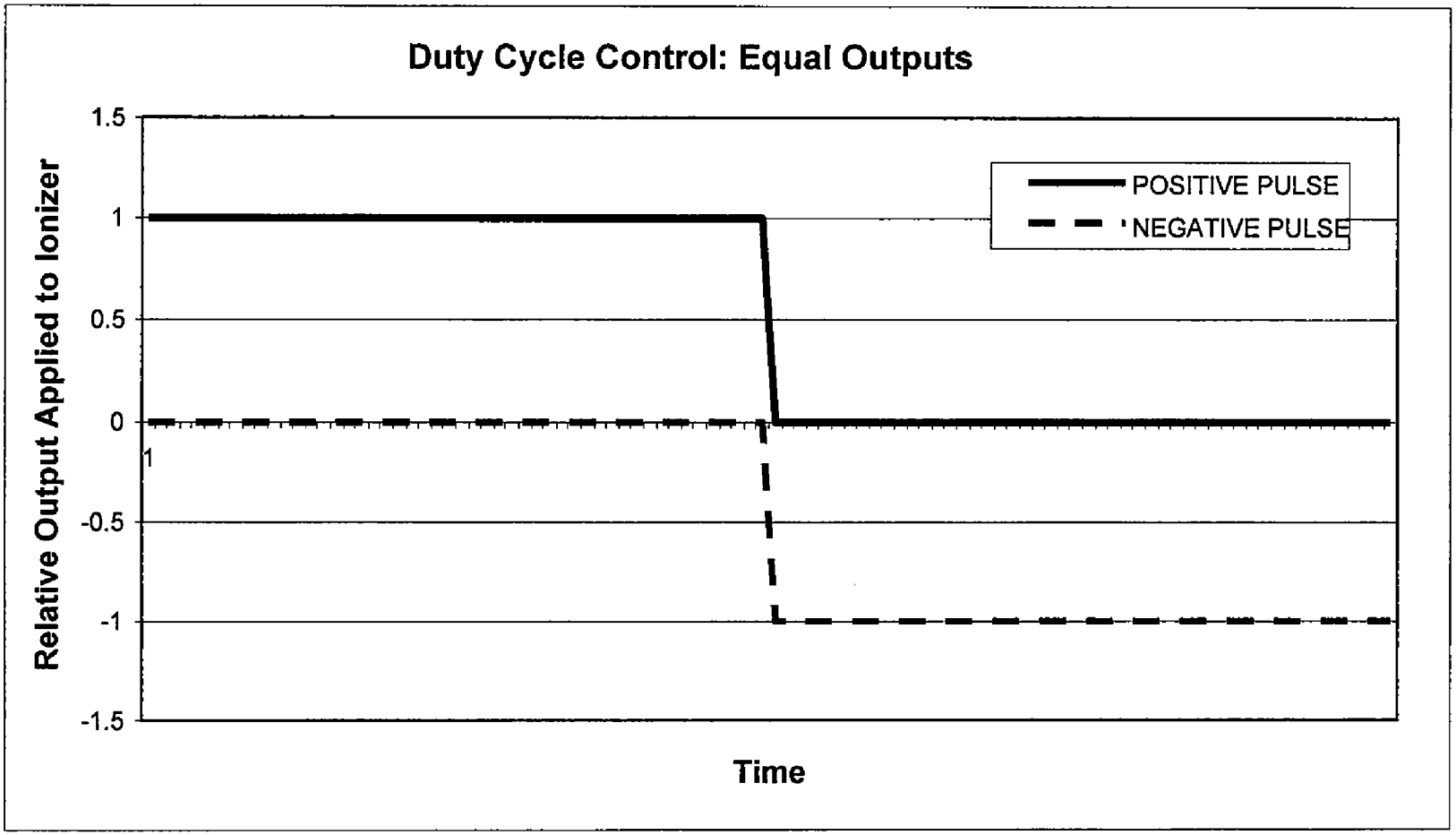
FIG. 5 is a graph showing pulses under duty cycle control for the case of equal output.
Figure 6:
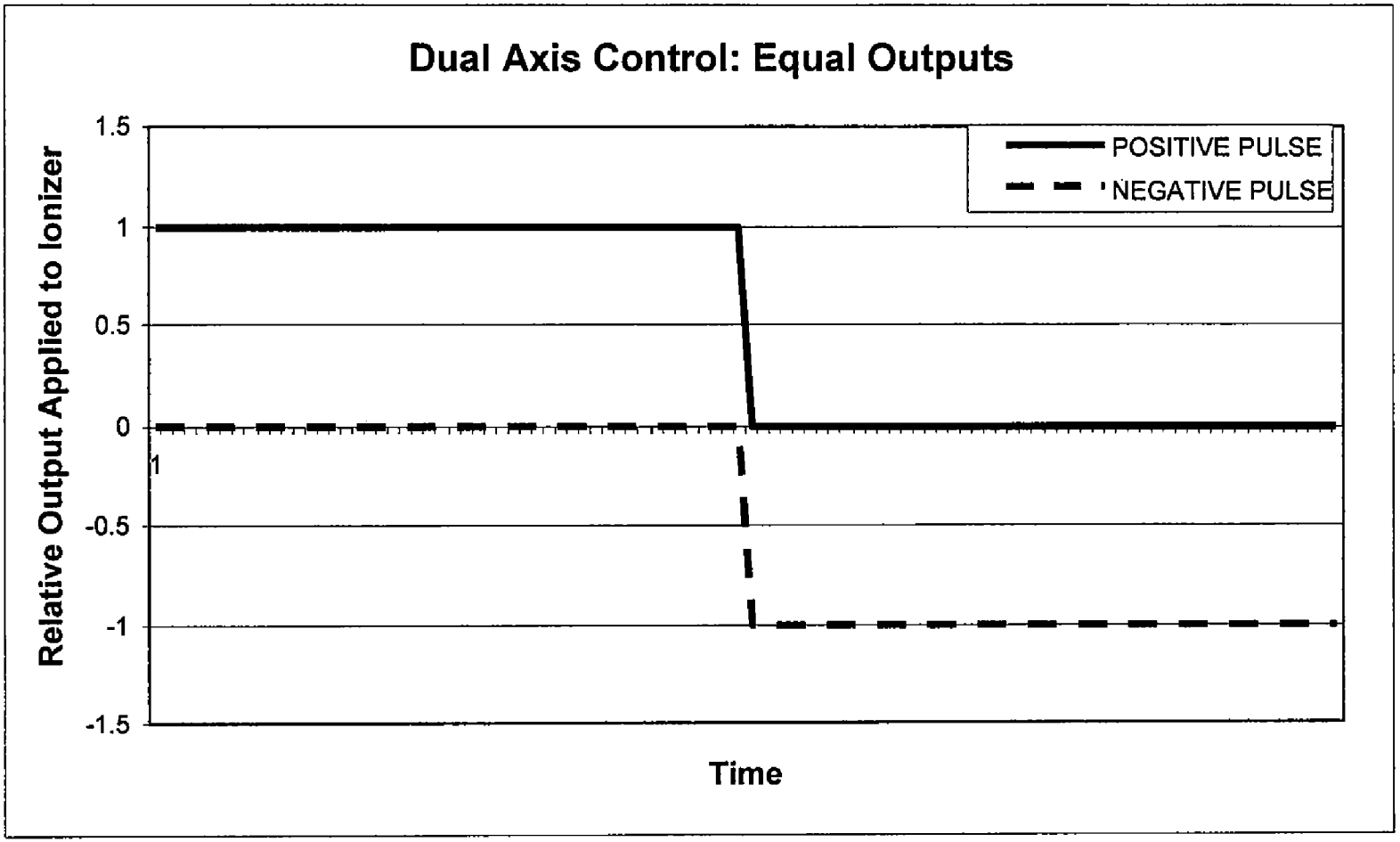
FIG. 6 is a graph showing pulses under dual axis control for the case of equal output.

FIGS. 4 and 5 are graphs that illustrate the individual adjustments of amplitude and duty control for equal outputs. FIG. 6 is a graph illustrating the dual axis combination of amplitude and duty control for equal outputs. FIGS. 16A-18B are tables of the data used to create the graphs shown in FIGS. 4-6. Note for the graphs in FIGS. 4-6 the equal and opposite amplitudes and equal pulse durations.

Figure 7:
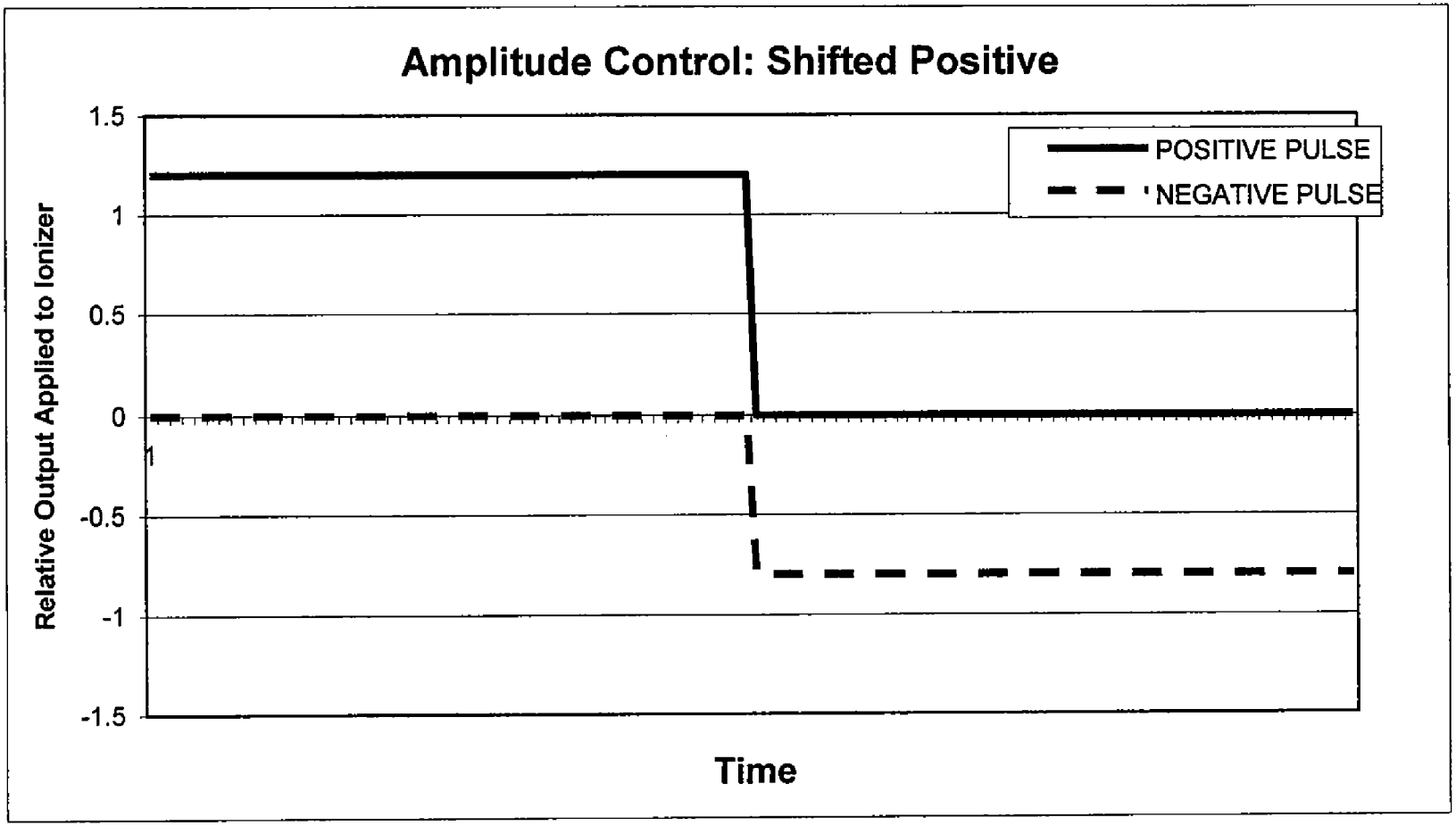
FIG. 7 is a graph showing pulses under amplitude control for the case of a positive shift.
Figure 8:
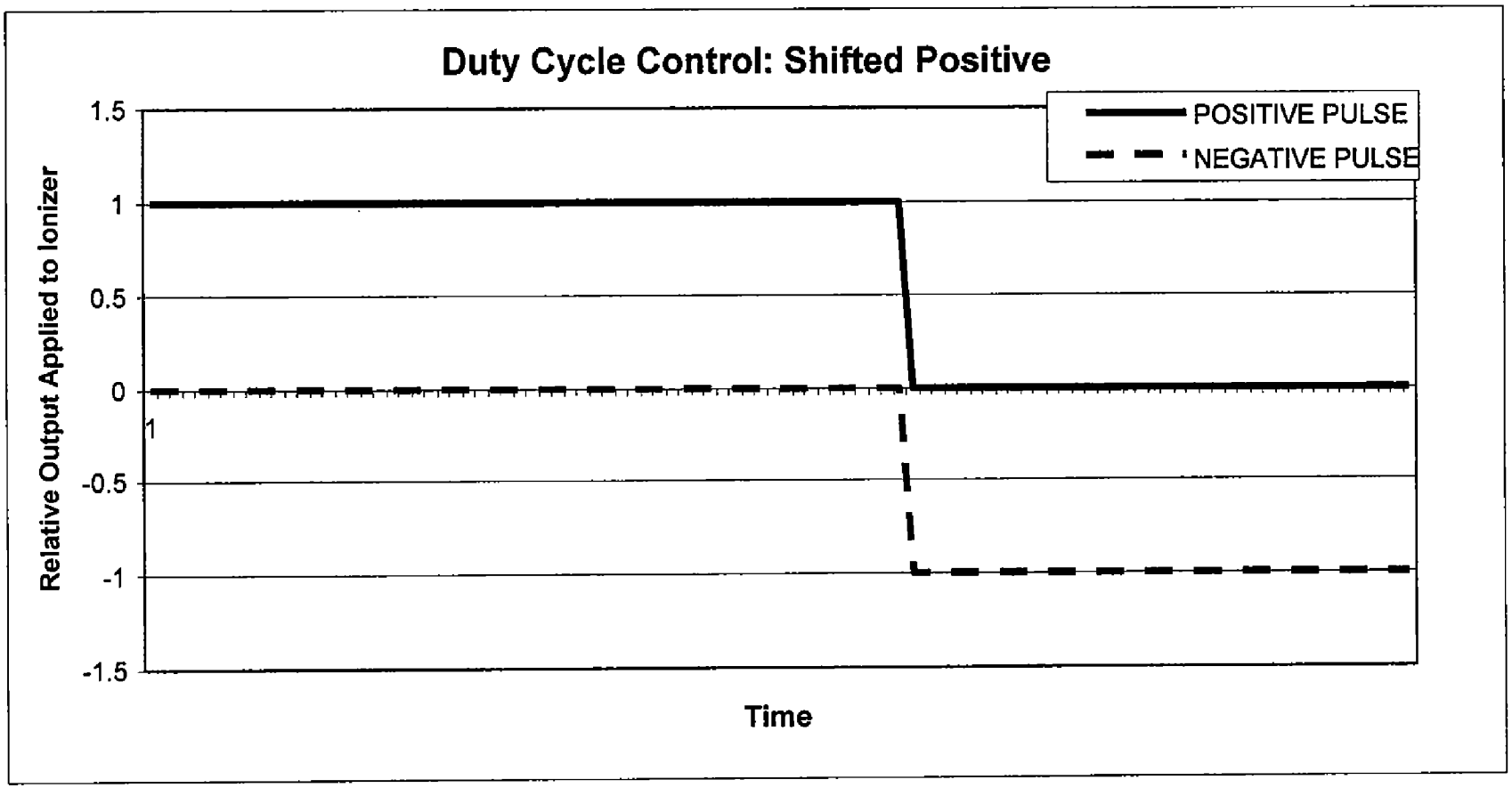
FIG. 8 is a graph showing pulses under duty cycle control for the case of a negative shift.
Figure 9:
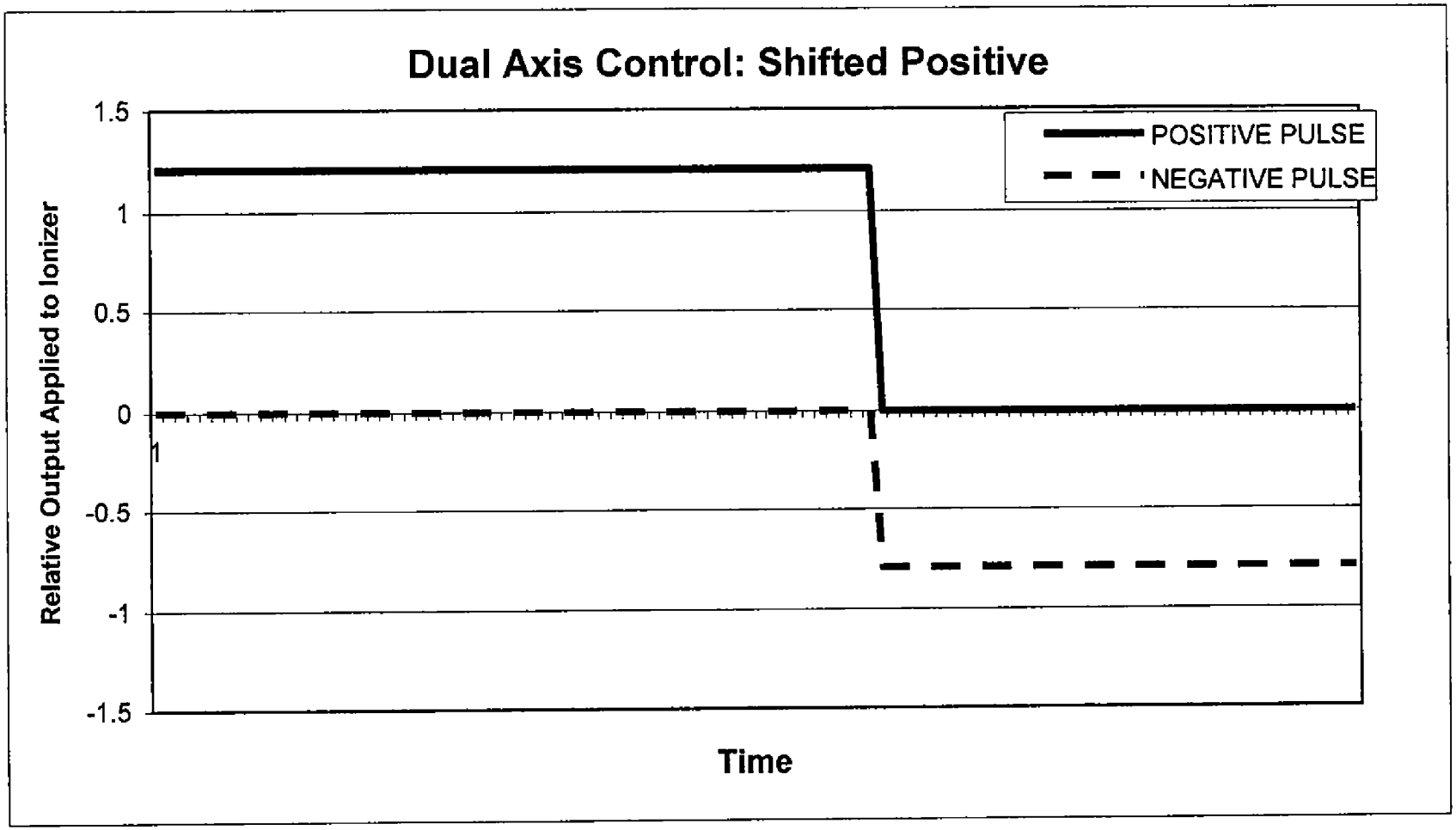
FIG. 9 is a graph showing pulses under dual axis control for the case of a positive shift.

FIG. 7 illustrates the amplitude control shifted positive. Note the increased relative positive output with respect to the negative output, and the equal pulse durations. FIG. 8 illustrates the duty cycle control shifted positive. Note the increased relative duration of the positive pulse with respect to the negative pulse, and the equal pulse amplitudes. FIG. 9 illustrates an increased area of relative duration and amplitude of the positive pulse with respect to the negative pulse when the adjustments to amplitude and duty cycles occur simultaneously. The tables found in FIGS. 16A-18B include data used to create the graphs shown in FIGS. 7-9.

Figure 10:
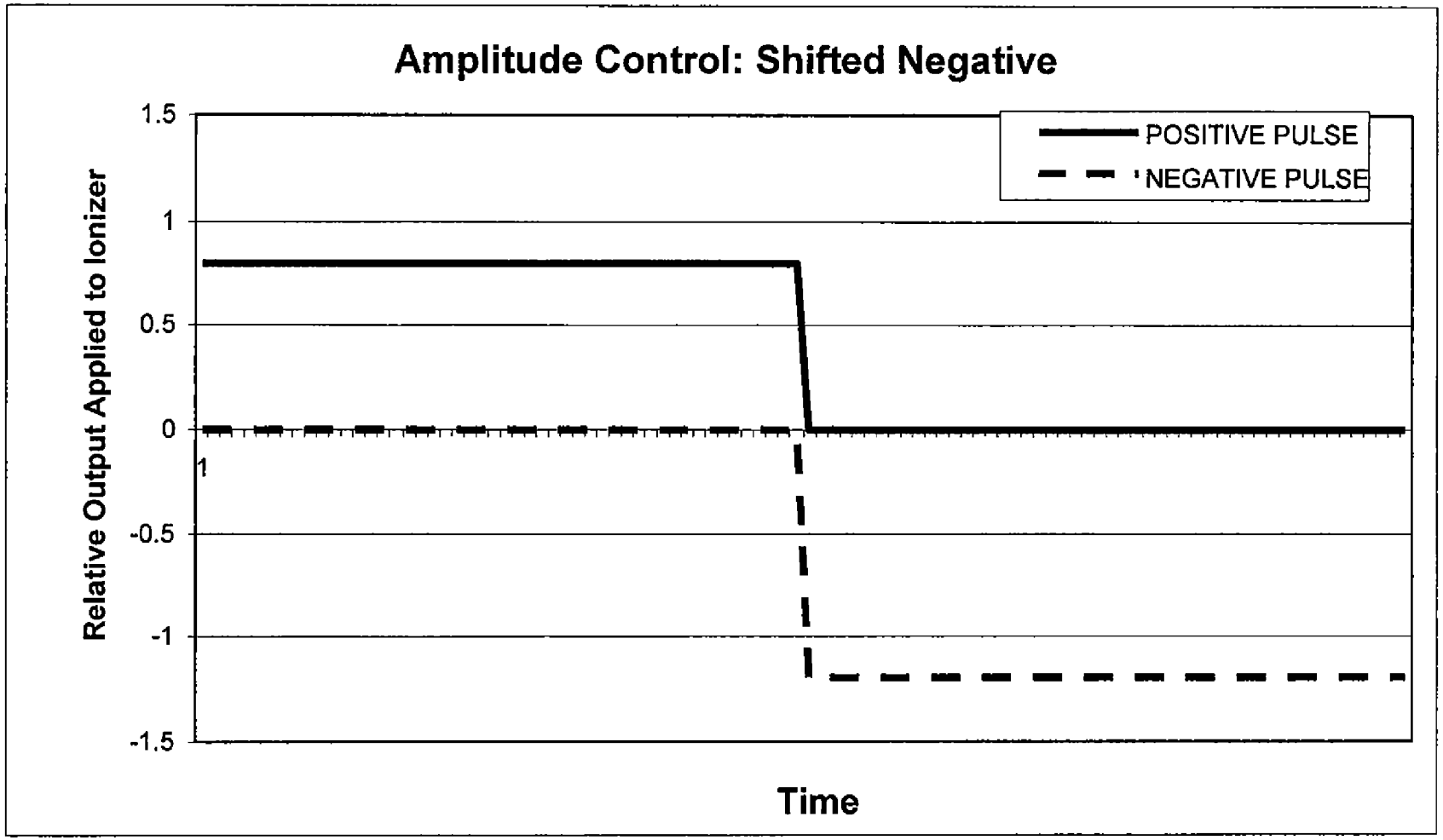
FIG. 10 is a graph showing pulses under amplitude control for the case of a negative shift.
Figure 11:
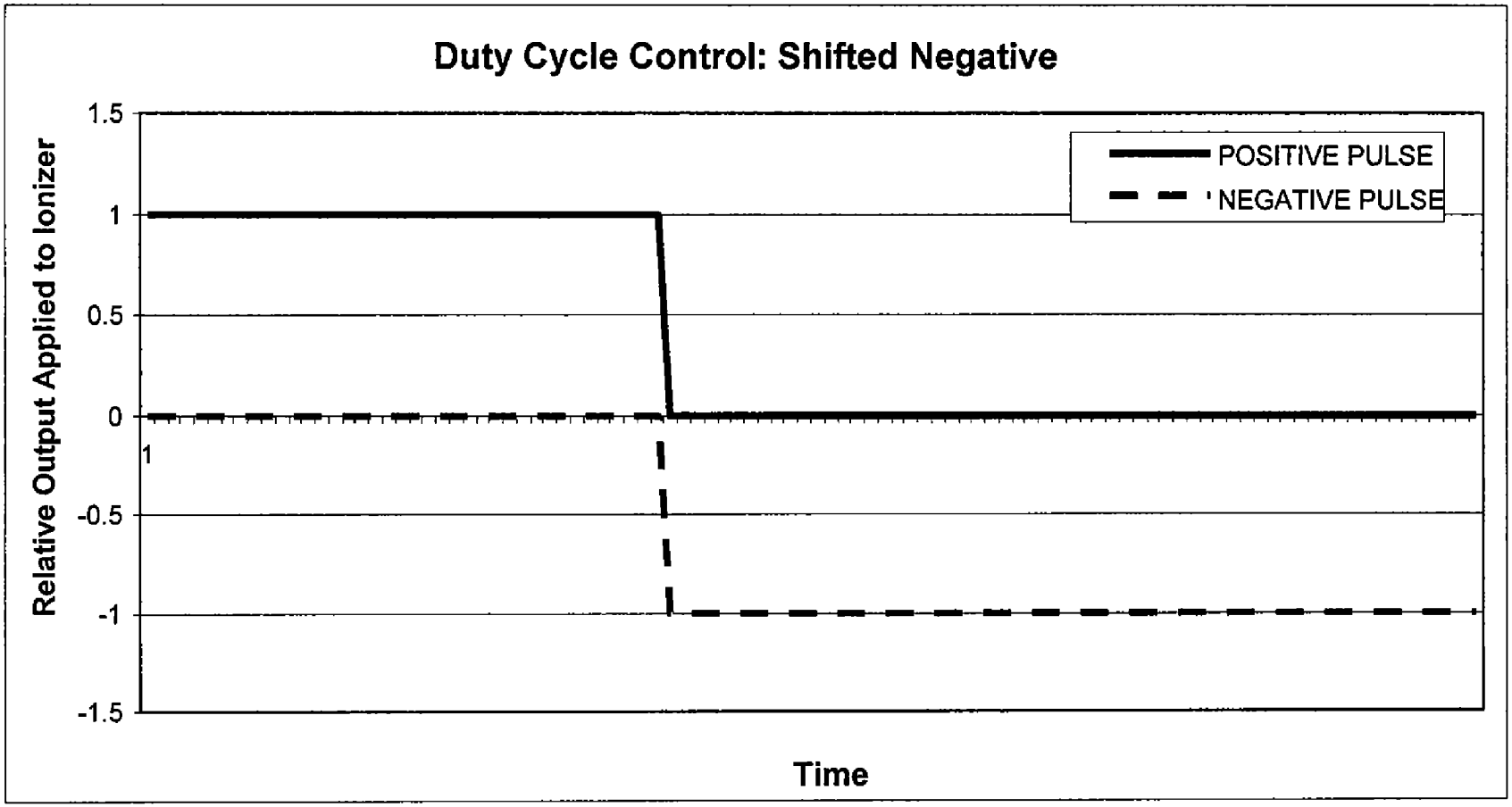
FIG. 11 is a graph showing pulses under duty cycle control for the case of a negative shift.
Figure 12:
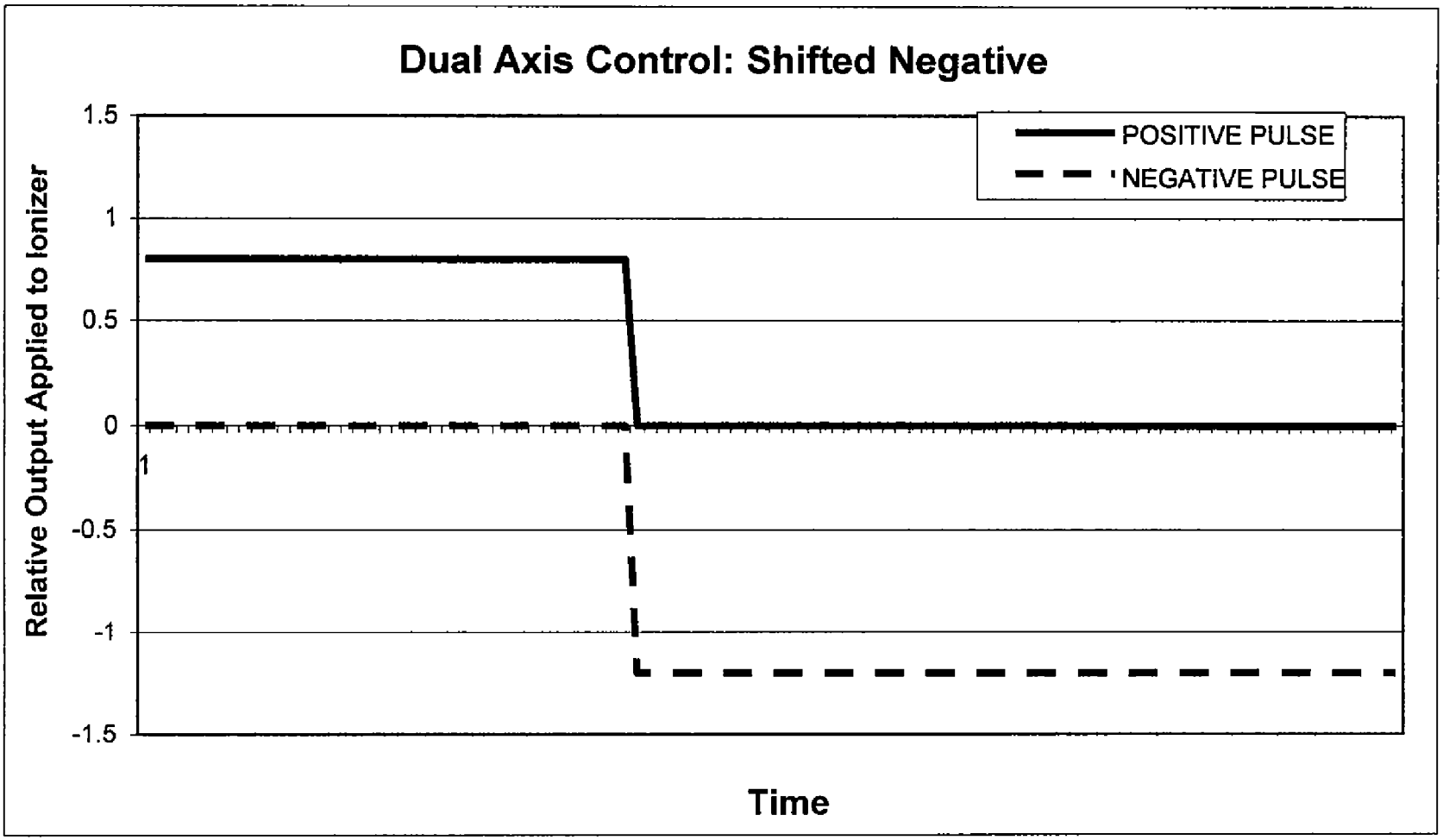
FIG. 12 is a graph showing pulses under dual axis control for the case of a negative shift.

FIG. 10 illustrates the amplitude control shifted negative. Note the increased relative negative output with respect to the positive output, and the equal pulse durations. FIG. 11 illustrates the duty cycle control shifted negative. Note the increased relative duration of the negative pulse with respect to the positive pulse, and the equal pulse amplitudes. FIG. 12 illustrates an increased area of relative duration and amplitude of the negative pulse with respect to the positive pulse when the adjustments to amplitude and duty cycles occur simultaneously. The tables found in FIGS. 16A-18B include data used to create the graphs shown in FIGS. 10-12.

Figure 13:
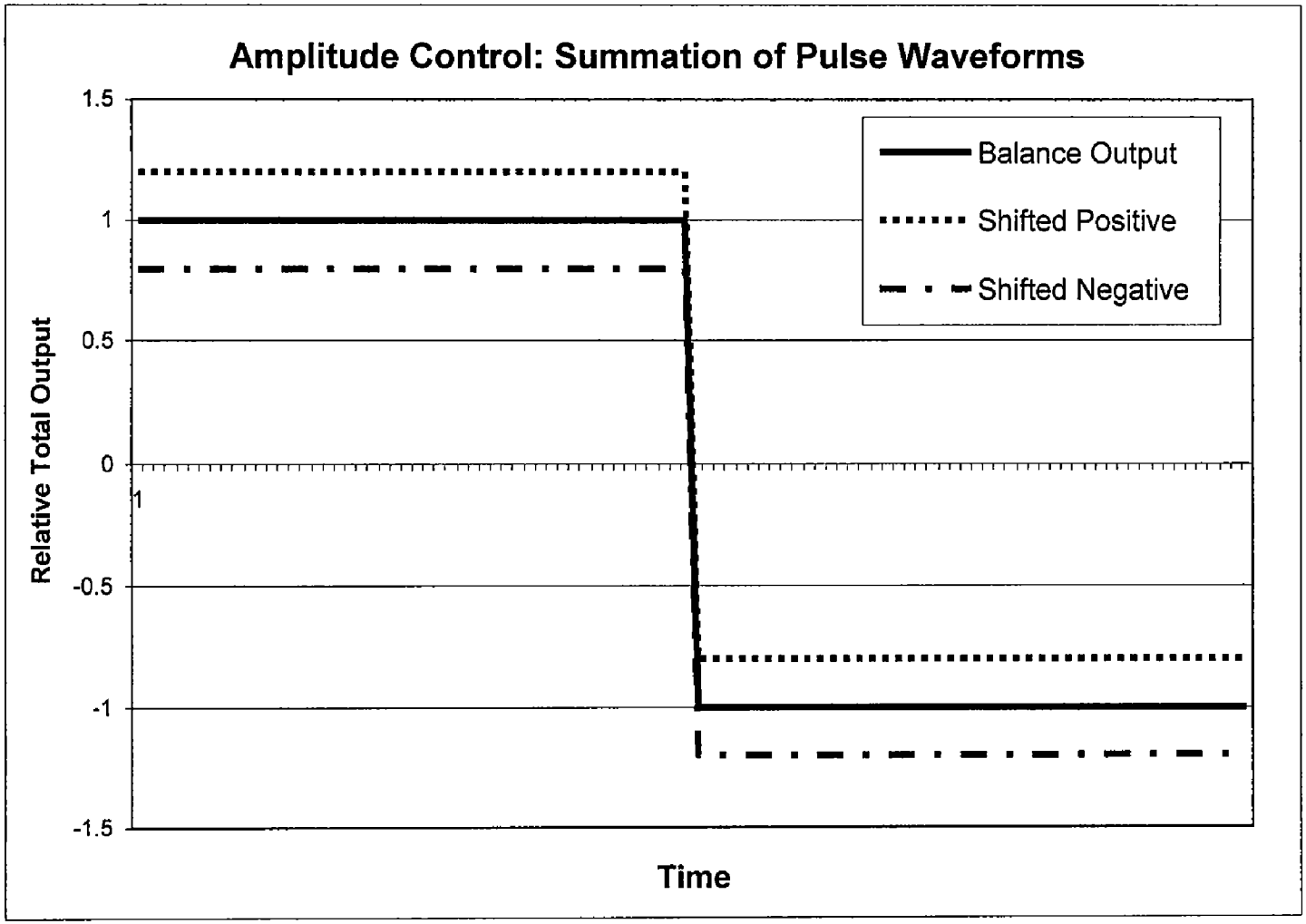
FIG. 13 is a graph illustrating the individual summation of pulse waveforms under amplitude control.
Figure 14:
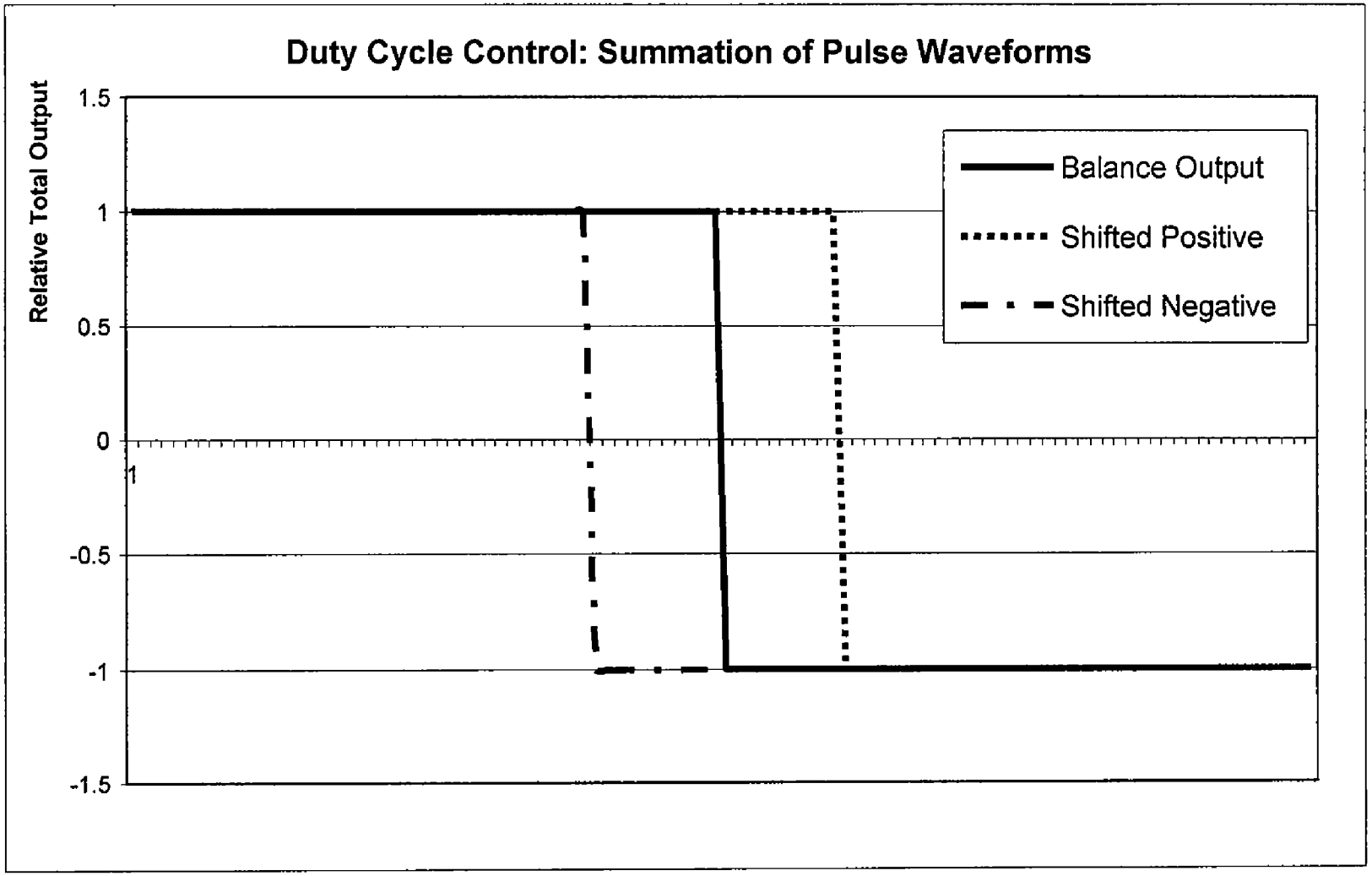
FIG. 14 is a graph illustrating the individual summation of pulse waveforms under duty cycle control.
Figure 15:
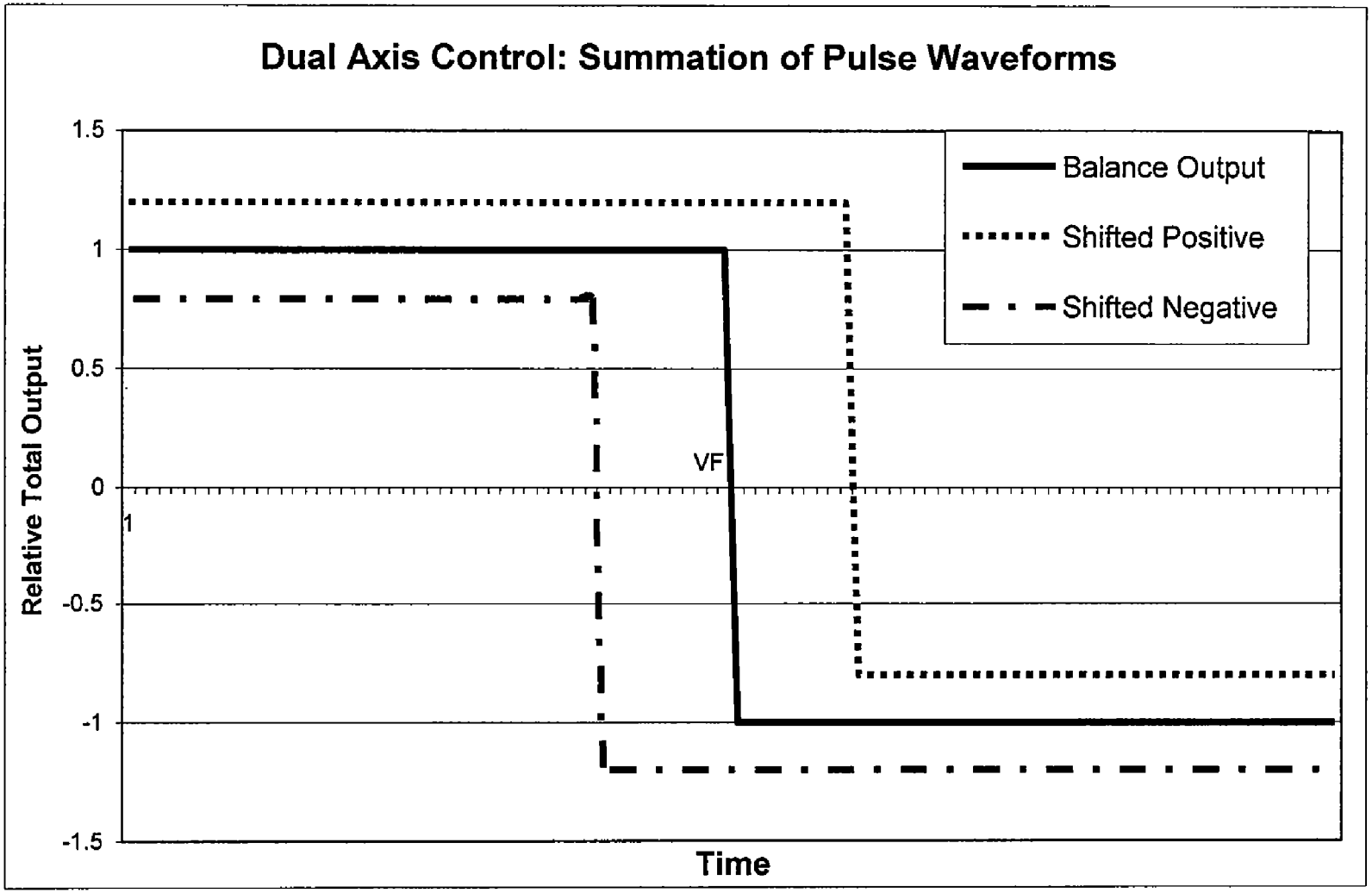
FIG. 15 is a graph illustrating the individual summation of pulse waveforms under dual axis control.

FIGS. 13 and 14 show graphs illustrating the individual summation of pulse waveforms of amplitude control (FIG. 13), and the summation of pulse waveforms of duty cycle control (FIG. 14). FIG. 15 shows an increased range of adjustments by the overall combination of positive amplitude resolution and time axis resolution when the adjustments to amplitude and duty cycles occur simultaneously. The tables found in FIGS. 16A-18B include data used to create the graphs shown in FIGS. 13-15.

Figure 19:
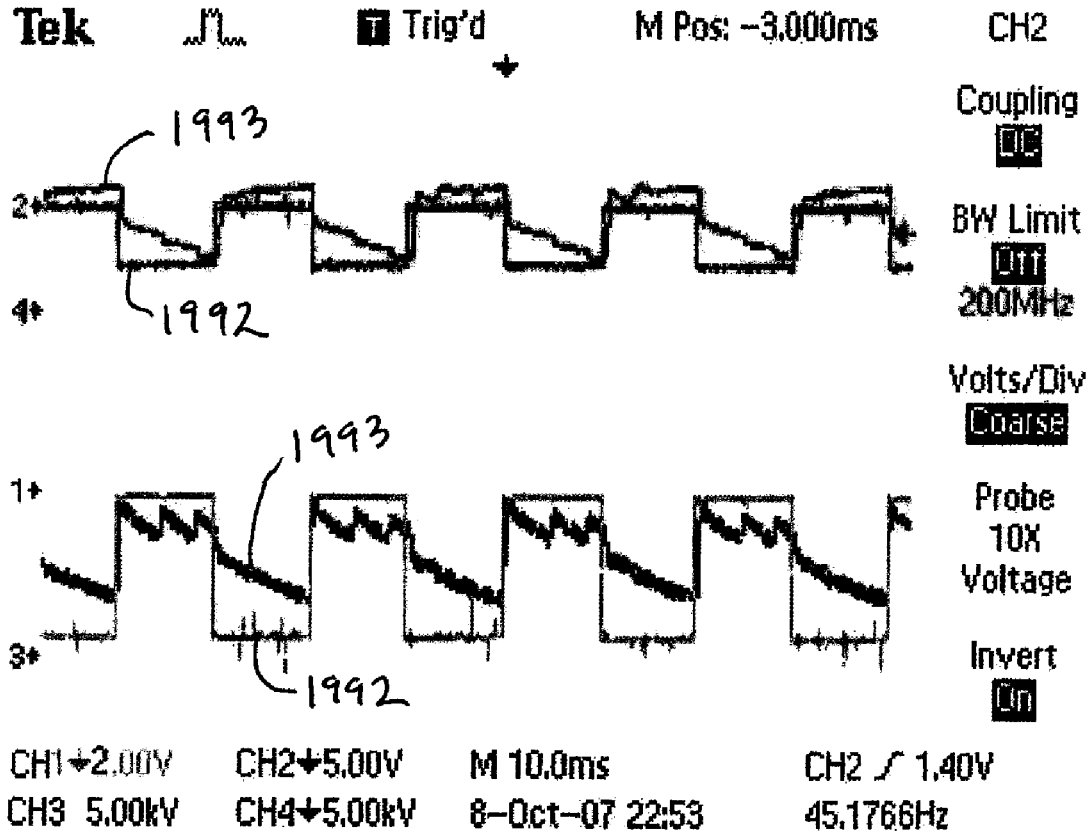
FIG. 19 is a graph of HV enable timing signals and HV outputs before application of the multi-axis control in accordance with a preferred embodiment of the present invention.
Figure 20:
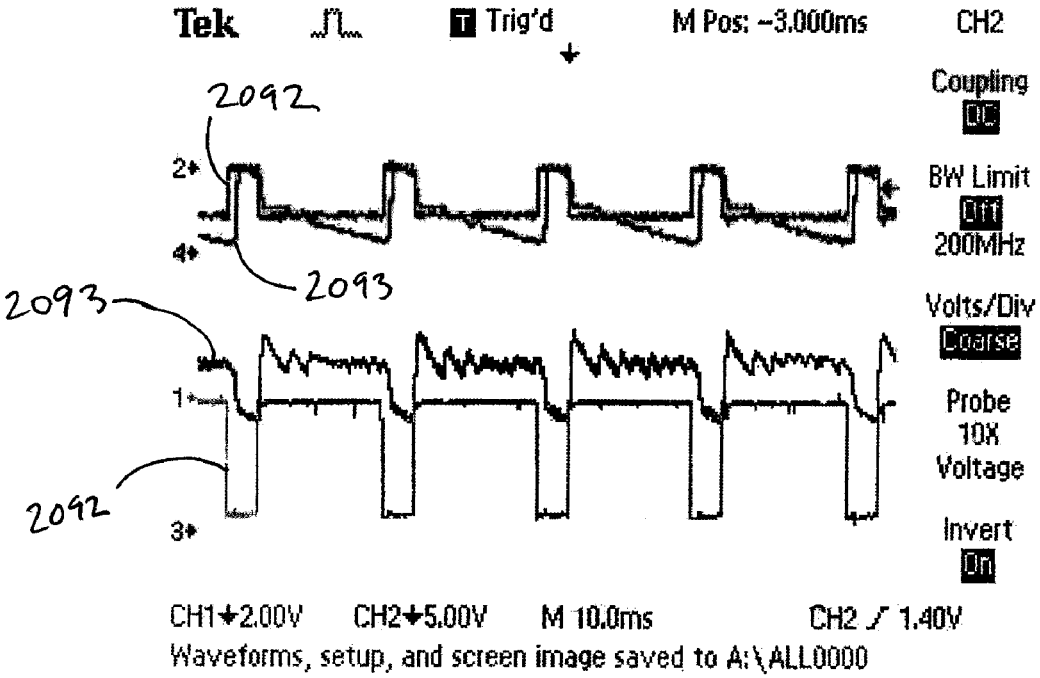
FIG. 20 is a graph of HV enable timing signals and HV outputs after application of the multi-axis control in accordance with a preferred embodiment of the present invention.

FIG. 19 is a graph of the HV enable timing signals 1992 and the HV outputs 1993 before application of the multi-axis control to the ionization system in accordance with a preferred embodiment of the present invention. Note the even distribution of the duty cycle and the equal amplitudes of the HV outputs 1993. FIG. 20 is a graph of the HV enable timing signals 2092 and the HV outputs 2093 after application of the multi-axis control to the ionization system in accordance with a preferred embodiment of the present invention. Note the 20/80 distribution of the duty cycle and the unequal amplitudes of the HV outputs 2093.

FIG. 21 is a table of the baseline values of a plurality of modes in accordance with the preferred embodiments of the present invention. The table is a range of the upper and lower limits of the output levels for the operating modes of speed, hybrid, and distance with frequency.

Figure 22:
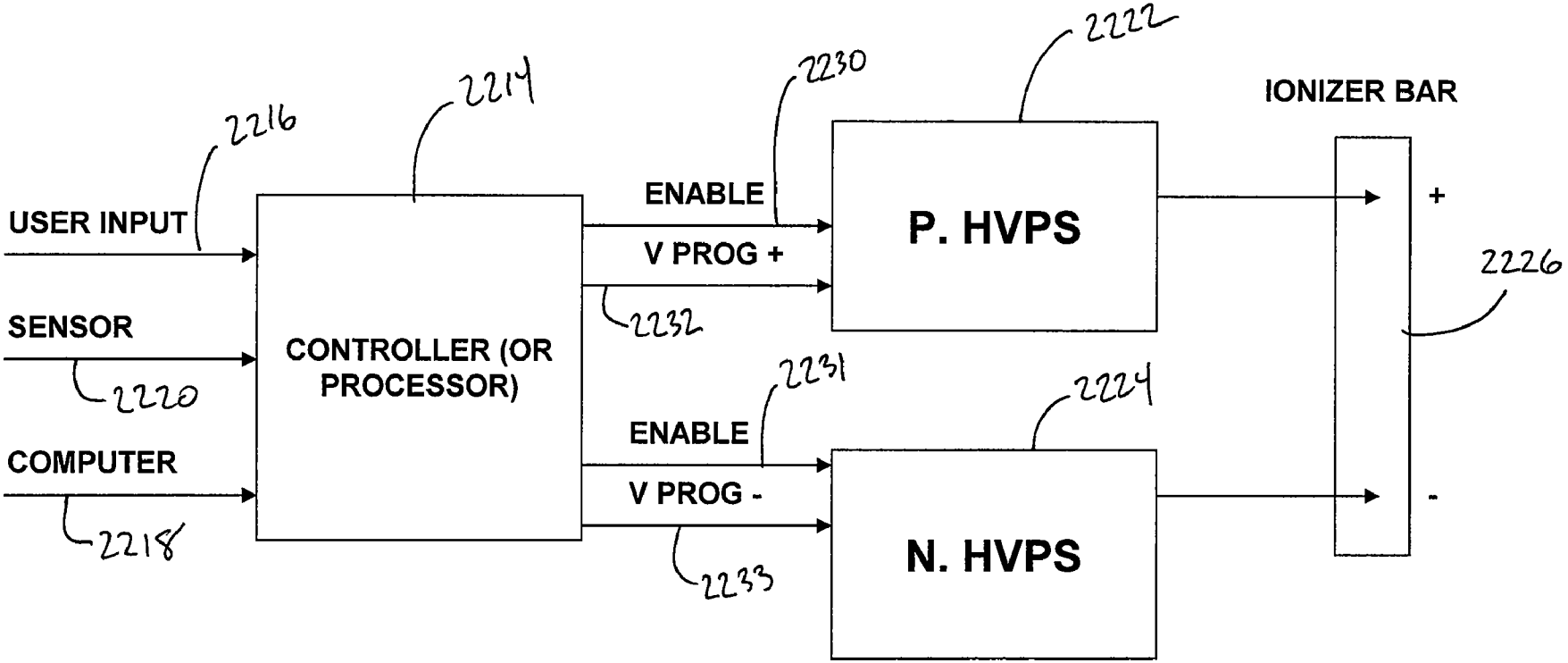
FIG. 22 is a schematic block diagram of a bipolar ionization system in accordance with a preferred embodiment of the present invention.

FIG. 22 is a schematic of a bipolar ionization system in accordance with a preferred embodiment of the present invention. As shown in FIG. 22, the enable signals 2230, 2231 set the timing of the high voltage pulses and the V prog± signals 2232, 2233 set the output level. In the system illustrated, the system is responsive to the input from the user 2216, sensor 2220, computer 2218, or other source. Emitters (not shown) on the ionization bar 2226 are uniquely positive or uniquely negative.

Figure 23:
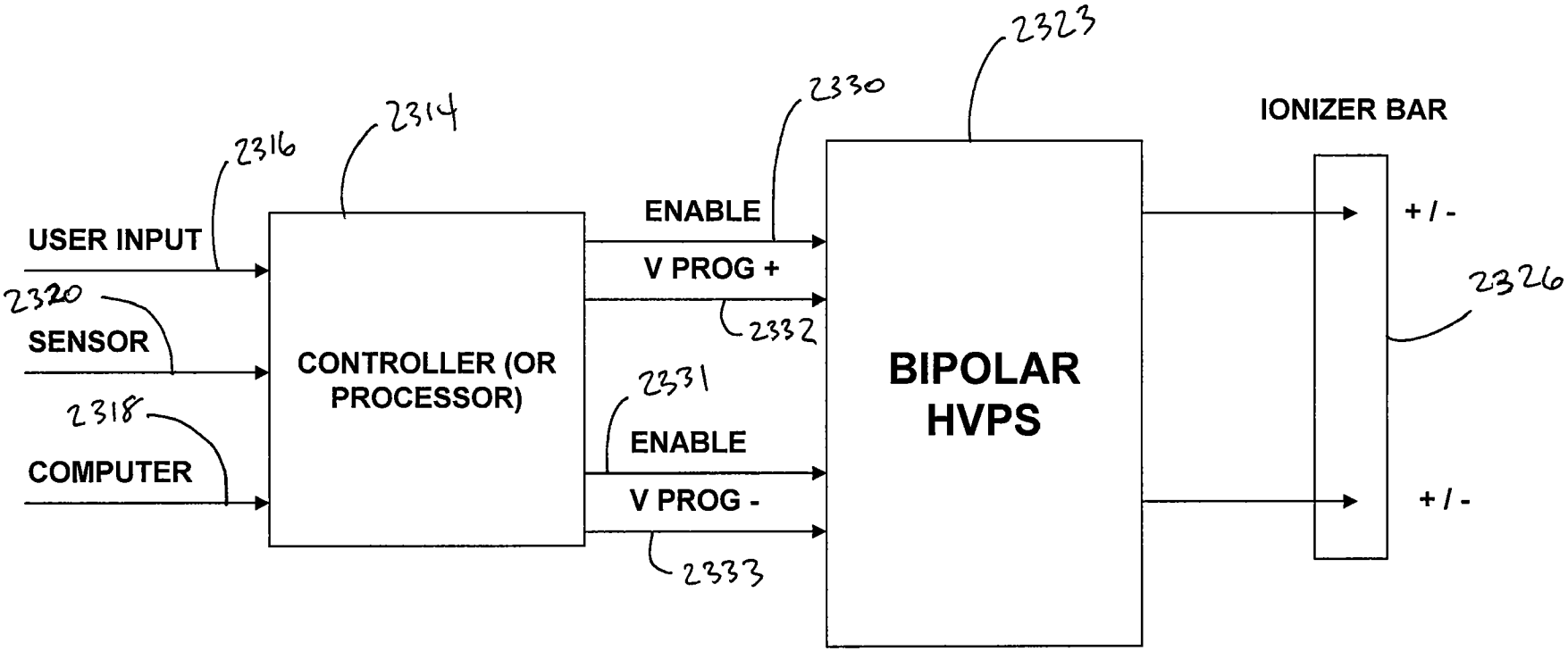
FIG. 23 is a schematic block diagram of a bipolar ionization system in accordance with another preferred embodiment of the present invention.

FIG. 23 is a schematic of a bipolar ionization system in accordance with another preferred embodiment of the present invention. The system in FIG. 23 is similar to the system in FIG. 22, however, in this embodiment, the emitters are both positive and negative on the ionization bar 2326, coupled to a bipolar HV power supply 2323.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A bipolar ionization apparatus comprising:

a positive high voltage power supply having an output with at least one positive ion emitting electrode connected thereto and configured to generate positive ions;

a negative high voltage power supply having an output with at least one negative ion emitting electrode connected thereto and configured to generate negative ions; and a microprocessor for an ionizer having an input that receives charge data from an external sensor, the microprocessor outputting a positive and negative high voltage ionization waveform, wherein the microprocessor executes an algorithm configured to:

(i) determine, based upon the charge data received from the external sensor, whether an adjustment of a polarity of the ionization apparatus is required, (ii) simultaneously adjust an amplitude and a duty cycle of the waveform by incrementing or decrementing one or more respective check values for each of the amplitude and duty cycle, (iii) compare the check values to a set of limit values, and (iv) if the check values are within the limit values, change respective output values of the amplitude and duty cycle to the corresponding check values.

2. The apparatus of claim 1, wherein the controller further adjusts at least one additional characteristic of the waveform simultaneously with the amplitude and the duty cycle of the waveform.

3. The apparatus of claim 2, wherein the additional characteristic is one of frequency and waveform shape.

4. A bipolar ionization apparatus comprising:

a positive high voltage power supply having an output with at least one positive ion emitting electrode connected thereto and configured to generate positive ions;

a negative high voltage power supply having an output with at least one negative ion emitting electrode connected thereto and configured to generate negative ions; and a microprocessor having an input that receives charge data from an external sensor and executing an algorithm configured to:

(i) determine, based upon the charge data received from the external sensor, whether an adjustment of a polarity of the ionization apparatus is required, (ii) simultaneously adjust an amplitude and a duty cycle of the outputs of the positive and negative high voltage power supplies by incrementing or decrementing one or more respective check values for each of the amplitude and duty cycle, (iii) compare the check values to a set of limit values, and (iv) if the check values are within the limit values, change respective output values of the amplitude and duty cycle to the corresponding check values.

5. The apparatus of claim 4, wherein the controller is further configured to adjust at least one additional characteristic of the outputs of the positive and negative high voltage power supplies simultaneously with the amplitude and the duty cycle of the positive and negative high voltage power supplies.

6. The apparatus of claim 5, wherein the additional characteristic is one of frequency and waveform shape.

7. A bipolar ionization apparatus comprising:

a positive high voltage power supply having an output with at least one positive ion emitting electrode connected thereto and configured to generate positive ions;

a negative high voltage power supply having an output with at least one negative ion emitting electrode connected thereto and configured to generate negative ions, each of the outputs of the positive and negative high voltage power supplies having an amplitude and a duty cycle; and a microprocessor having an input that receives charge data from an external sensor and executing an algorithm configured to:

(i) determine, based upon the charge data received from the external sensor, whether an adjustment of a polarity of the ionization apparatus is required, (ii) selectively and incrementally adjust the amplitude and the duty cycle of the outputs of the positive and negative high voltage power supplies by incrementing or decrementing one or more respective check values for one of the amplitude and duty cycle, (iii) compare the check value to a limit value, (iv) if the check value is within the limit value, change respective output values of the one of the amplitude and duty cycle to the corresponding check value, and (v) repeat steps (ii)-(iv) for the other of the amplitude and the duty cycle.

8. The apparatus of claim 7, wherein each of the outputs of the positive and negative high voltage power supplies includes at least one additional characteristic, the controller being further configured to selectively adjust at least one of the amplitude, the duty cycle, and the at least one additional characteristic of the outputs of the positive and negative high voltage power supplies.

9. The apparatus of claim 8, wherein the additional characteristic is one of frequency and waveform shape.

10. A bipolar ionization apparatus comprising:

a bipolar high voltage power supply having an output with at least one ion emitting electrode connected thereto, the bipolar high voltage power supply alternately outputting positive and negative potential, the ion emitting electrode thereby alternately generating positive and negative ions; and a microprocessor having an input that receives charge data from an external sensor and executing an algorithm configured to:

(i) determine, based upon the charge data received from the external sensor, whether an adjustment of a polarity of the ionization apparatus is required, (ii) simultaneously adjust an amplitude and a duty cycle of the output of the bipolar high voltage power supply by incrementing or decrementing one or more respective check values for each of the amplitude and duty cycle, (iii) compare the check values to a set of limit values, and (iv) if the check values are within the limit values, change respective output values of the amplitude and duty cycle to the corresponding check values.

11. The apparatus of claim 10, wherein the controller is further configured to adjust at least one additional characteristic of the output of the bipolar high voltage power supply simultaneously with the amplitude and the duty cycle of the bipolar high voltage power supply.

12. The apparatus of claim 11, wherein the additional characteristic is one of frequency and waveform shape.

* * * * *